US005622281A

United States Patent [19]

Annand

[11] Patent Number: 5,622,281

[45] Date of Patent: Apr. 22, 1997

[54] DISPENSER FOR FOLDED SHEETS AND BULK PACKETS

[75] Inventor: Charles A. Annand, Truro, Canada

[73] Assignee: BFA Manufacturing Limited, Truro, Canada

[21] Appl. No.: 488,783

[22] Filed: Jun. 8, 1995

Related U.S. Application Data

[63] Continuation-in-part of Ser. No. 237,863, May 4, 1994, abandoned.

[30] Foreign Application Priority Data

| | | | |
|---|---|---|---|
| Jun. 2, 1993 | [CA] | Canada | 2097527 |
| Aug. 31, 1993 | [CA] | Canada | 2105246 |
| Mar. 7, 1994 | [CA] | Canada | 2117110 |

[51] Int. Cl.[6] ..... A47K 10/24

[52] U.S. Cl. ..... 221/48; 206/494

[58] Field of Search ..... 221/48, 49, 45, 221/33, 63, 282, 285; 206/233, 494, 812

[56] References Cited

U.S. PATENT DOCUMENTS

| | | | |
|---|---|---|---|
| 3,144,961 | 8/1964 | Phenner | 221/48 |
| 3,161,336 | 12/1964 | Loescher | 206/494 |
| 5,305,881 | 4/1994 | Caldwell et al. | 206/494 |

*Primary Examiner*—Kenneth Noland

[57] ABSTRACT

Broadly, the present invention provides a folded sheet dispenser with a vertical end opening extending into the top with a unique, new and novel, internal control plate which controls the one at a time consecutive removal of folded sheets in a horizontal and somewhat vertical direction from within the dispenser and through the end opening. This folded sheet dispenser with the end opening and the internal control plate are the two basic features of this invention which can be combined in the refillable, molded plastic design as well as with the disposable cardboard design. The refillable dispensers in various configurations will accept a packet of folded sheets which have been compressed to reduce shipping costs and are placed inside the dispenser body through the bottom or the end and are then dispensed through the vertical end slot and controlled by the internal control plate which floats on top of the top most folded sheet inside the dispenser and controls the interply friction between the interlayers of folded sheets where it dispenses one, and only one, folded sheet at a time and causes the next consecutive folded sheet to automatically protrude through the end opening as a folded sheet is removed. Where the layers of folded sheets are exposed at the vertical end opening they may also be removed as a small packet of folded sheets. The other new and novel feature of my invention is the compresses packet of folded sheets, restrained by a wrapper or plastic sleeve, and which are contained within a poly wrapped bulk pack, with or without, the molded plastic dispenser included within the bulk pack as detailed and as taught in this invention.

16 Claims, 19 Drawing Sheets

DISPENSER FOR FOLDED SHEETS AND BULK PACKETS

This is a Continuation-In-Part U.S. patent application Ser. No. 08/237,863 filed on May 4, 1994, now abandoned.

BACKGROUND (1) Field of the Invention

This invention relates to a series of dispensers for folded sheet products, and more particularly facial tissues, which dispensers may refillable or of a disposable nature for serially dispensing interfolded and interleaved sheet products, from a compressed packet or from a loose pack of folded sheets one sheet at a time though an integral end opening which extends into the top of the dispenser and where the folded sheets are controlled by an internal control plate.

(II) Cross Reference to Related Applications

The enclosed invention relates to the inventor's previously applied for Canadian Patent Application, Serial No. 2,097,527; dated Jun. 2, 1993 and entitled "TISSUE BOX FOR BULK TISSUE PACKETS", wherein the inventor makes claim for a facial tissue container with an end opening in the end wall for the progressive removal of facial tissues one at a time. This previous invention of an end opening container for bulk packets was for a free-standing container of semi-permanent nature.

A second Canadian Patent Application, Serial No. 2,105,245, dated Aug. 31, 1993, entitled "FACIAL TISSUE CONTAINER FOR MOUNTING UNDER A STRUCTURE", includes the same embodiments of the first application except that the container has been mounted horizontally to a support structure and also uses bulk packets of tissues from a bulk pack.

A third Canadian Patent Application, Serial No. 2,117,110, dated Mar. 7, 1994, entitled "DISPOSABLE FACIAL TISSUE DISPENSER", is the same as my first embodiment of this U.S. application Ser. No. 08/237,863. The invention is based on the two basic principals of my two previous applications, the end opening and the internal control plate with the tissue removed somewhat horizontally, however it does not use compressed tissue packets, the dispenser is filled at the manufacturing plant.

(III) Discussion of Prior Art

This invention relates to folded sheet dispensers and the packaging of folded sheet products as used in these dispensers, and more particularly to containers or dispensers of facial tissues which are designed to allow and facilitate the progressive removal of tissues from such a dispenser, sequentially through a discharge opening.

With presently available boxes of facial tissues, it is frequently difficult for a person to remove a single tissue from the box in the intended manner after some of the tissues have been removed. One previously proposed solution to this problem has been directed to the serial but releasable interconnection of the tissues so that as one tissue is removed through the top opening, a subsequent tissues is partially unfolded and pulled into the neck of the discharge opening. Such a known system has, however, shown some tendency to be somewhat unreliable in that the desired separation of the two connected tissues is not always obtained in the neck of the discharge opening, while on other occasions, successive tissues sometimes separate within the box or container. The interfolded tissues then fall back by gravity into the box and there is no protruding tissue to be removed. The user then has to thrust his hand into the top opening to grasp a number of tissues and pull them up through the top opening which results in more than one tissue being removed and in most cases a bunch, or handful, of tissues are removed which results in wasted tissues and an inconvenience and needless expense to the user. This is more prevalent with children than adults and often causes the cardboard box to be turn and results in the complete box of tissues being wasted.

The basic concepts of may invention of an end opening dispenser with an internal control plate where the folded sheet is withdrawn somewhat horizontally forms the bases of all the enclosed embodiments of my invention and overcomes the difficulties associated with all the know prior art that I was able to locate.

According to one aspect of the present invention there is provided a container for dispensing tissues from a stack of folded tissues having reverse folds at opposite sides of the stack. The container includes opposite side panels and opposite sides of the stack disposed adjacent the opposite side panels and ends at the stack disposed adjacent the end panels. A control plate which has a lower tissue engaging surface portions rests on top of the stack. One of the ends panels has a tissue removable slot extending downwardly from an upper edge thereof for exposing at least a portion of one end of the stack. A top tissue of the stack is accessible for removable endwise from beneath the control plate, and due to the friction resistance between the top tissues and the immediately subsequent tissue in the stack, the subsequent tissue is drawn by the removal of the top tissues to an accessible position projecting endwise partially through the end opening, vertical slot.

In a specific embodiment of the invention, the container includes a top panel joined to the end panels along top end edges and the top panel has an opening communicating with the vertical extending slot of the one end panel.

More specifically, an end of the control plate adjacent the slot of the end panel may have a cutaway portion to expose the top tissues of the stack below the opening of the top panel.

According to another aspect of the invention there is provided a container for dispensing tissues sequentially from an interleaved stack of tissues, the tissues having reverse folds at opposite sides of the stack. The container includes a pair of opposite end walls and a control plate for resting on the top of the stack. One of the end walls has a vertical slot therein for endwise removal of one tissue at a time from beneath the control plate. The control plate has longitudinal side edges spaced apart a distance substantially equal to the width of the stack, and a pair of longitudinally extending stack engaging surface portions is disposed adjacent the side edges of the control panel. The stack engaging surfaces are transversely spaced a distance less than the width of the stack. Theses stack engaging surfaces with the plastic control plates and also with the molded cardboard plates have a series of ridges or a textured undersurface which will control the drag between the second tissue as the top tissue is removed from the underside of the control plate.

Because the tissues depend on the interply friction between the layers to be progressively removed, the design allows for a greater area of friction to assist in tissue removal. The end opening of the container is not affected by gravity which disrupts the tissue removal with top opening boxes which are now the standard for the industry.

Preferably the control plate of this invention is crowned or raised on the centerline portion which will then allow a space to be provided between the top of the tissues and the underside of the control plate to prevent the tissues from being jammed against the top of the container as they are placed inside the container such a jammed condition causes a first lot of tissues to be restricted when they are removed, thus, resulting in torn and wasted tissues. This space is provided under the control plate which floats on top of the tissue packet as the tissues are removed, the plate providing a positive pressure to the two edges of the tissues to maintain the friction necessary for proper tissue removal. A space is provided under the plate to facilitate the removal of the tissues at the centerline of the container and prevents jamming and tearing of the tissues when they are removed.

Yet another aspect of this invention is to provide a reusable and somewhat permanent container for tissues which can be of durable, washable, and of relatively low cost, injection molded plastic. The reusable container allows use of bulk packets of tissues which would be packaged in multiples of two or more packets for a bulk package of six, nine or twelve packets, or such similar multiples. Thus the invention may be in the form of a somewhat permanent container to replace the paperboard boxes now in use and to also replace the corrugated cardboard boxes used to ship the smaller tissue boxes. This results in cost savings of materials, shipping and warehouse costs due to reduced volume. Savings would also be possible to landfill disposal sites and the enviroment.

The North American production of facial tissue in 1992 was *186 billion single tissues which represents approximately 50,000 tons of cardboard for the disposable tissue boxes or approximately 500,000 trees. The disposable dispensers as taught in the prior art could not be refilled by the user, as with my invention, and had to be filled at the manufacturing plant with relatively loose tissues in order that they could be removed without tearing the tissue. Therefore, compressed tissue packets, where herebefore not possible or practical without my refillable dispenser.

Kimberly Clark 1992 Annual Report

Thus, according to this further aspect of the invention, there is provided a refillable container for dispensing tissues from a stack of folded and interleaved tissues, the container including a pair of opposite end panels, a pair of opposite side panels and a top panel, at least one of the panels providing a tissue dispensing opening. There is also provided a removable bottom panel. The panels define a stack enclosure, and at least one of the pair of panels and the bottom panel have releasable interlocking means for holding the bottom panel in a closed position and allowing selective removable of the bottom panel for refilling of the container with a fresh stack of tissues.

According to yet a further aspect of the invention there are provided a package which consists of plurality of like individual, compressed packets of tissue. Each packet includes a stack of interleaved, reverse folded, separate tissues for use as an insert in a refillable dispensing container. The rope of tissue is initially formed to a specific height and subsequently compressed to a shorter height. The packet includes a wrapper or sleeve encircling the compressed stack for maintaining the stack substantially in the shorter height in the compressed packet. A plurality of individual packets are then stacked to form a substantially rectangular block and an outer wrap completely encloses the rectangular block.

Where bulk packets of tissues are used they are in a compressed nature which because of their resilience rebound to their original shape and volume, and this compressed package of tissues will easily fit into the space of the container and the bottom platform is then placed. More specifically, the packets of tissues are reduced in volume when they are packaged by approximately 20% or more which reduces the cost of shipping and warehousing to the manufacturer as well as the distributor and the retailer, which costs are then passed on to the buyer to reduce the cost of the product.

As indicated, a packet of interleaved tissues of a preset width and length and of 300 tissues, more or less, may be compressed in height and held with a wrapper or poly sleeve and then multiples of these packets are further compressed and placed in a poly wrap in multiples of two or three or four to form an economical package of facial tissues in bulk form.

And to further reduce costs the refillable dispenser in most of the embodiment designs of my invention can be placed directly within the bulk package. This will then allow the dispenser with a packet or more, placed inside the open bottom, to be sold with the bulk pack to save costs in packaging and shipping. The detached bottom and the control plate are then placed elsewhere inside the bulk pack.

Generally the tissue dispensing containers in these prior art patents are all of a disposable nature and generally constructed of number 220 paperboard sheet which is the nomenclature used in the industry. These dispensers as patented where for folded sheet products and more specifically for folded facial tissues.

All the previous inventions which taught an internal control plate used a substantially flat plate which moved vertically within the container for the full height inside the container and moved upward with the tissue as it was withdrawn and then fell back by gravity. There dispensers have since been abandoned.

No inventions were found that taught the dispensing of an interleaved and folded sheet through an end opening, in a horizontal direction, and where these sheets where controlled by an internal control plate resting on top of the tissue pack.

In regard to the prior art on Folded Sheet Packages and Bulk packs my invention allows the compression and restraint wrapper to be applied directly to a continuous rope of tissues or folded sheet products at the end of the production line and then for the packets are cut to length in a continuous method.

(IV) Objects and Advantages

Accordingly, several objects and advantages of my invention are a control plate which is substantially different and teaches a new control means over the succeeding plies of folded sheets to allow them to be removed from the end opening of the dispenser one folded sheet at a time. The control plate which has an engineered shape with a crown on the longitudinal centerline of the plate promotes the folded sheets to flow from side to side underneath the control plate in the unrestricted space provided by the crowned shape of the plate which plate is allowed to move vertically at the end opening of the dispenser as is shown in FIGS. 15, 16 and 17 where a folded sheet is withdrawn it lifts the control plate to cause it to move from front to back and from side to side while maintaining a controlled pressure on the top-most folded sheet by the design of the upswept edges of the control plate where it has two edges in contact with the top folded sheet at any given time to maintain a controlled inter ply friction between the successive layers of the folded sheets. As is shown in FIG. 9 the control plate is in the normal flat position and it was found from experimentation that is should be of a rigid material to maintain its shape and should have a weight relative to the desired tissue projection and which would have a textured undersurface to prevent the tissue from projecting too far, and with the two outer tissue engaging surfaces textured to give added drag to the succeeding tissue.

The control plate would also be made from a low cost material of molded cardboard stock with the disposable dispenser and of molded plastic with the refillable dispensers which would retain its molded shape over the expected life of the dispenser as shown in FIGS. 13 and 14 as depicted by these patent drawings. The relatively flat control plates as taught in the beforementioned patents were of a conventional untreated flat cardboard and were not molded to a designed shape which is as described and detailed in my invention.

The disposable dispenser or disposable container as envisioned in my invention is similar in shape and size to the containers now used by all the major folded sheet manufacturers and is of a low cost, recycled cardboard material designated as number 220 sheet stock which is the standard of the industry. As shown in FIG. 1 the cardboard box or container would have a perforated end panel which would be removed by the user.

With my disposable dispenser when the cardboard container is filled with folded sheets on the manufacturing production line, the control plate would then also be placed inside the container and on top of the folded sheets and the box would then be sealed by conventional means now used by the industry.

With the conventional top oval opening boxes of a quantity of 175 or 150 tissues which have been most popular for years, the manufacturers in order to produce a more economical tissue box have made a similar box of 300 or more tissues using the same top opening "pop-up" box technology and as the tissues are partly used the tissues tend to fall back into the box and are difficult if not impossible for small children and others to remove conveniently and quickly. The cardboard boxes of 300 tissues contain double the number of facial tissues as the original 175 or 150 facial tissue boxes with the same "pop-up" design features which worked well with the original boxes but have become a source of annoyance and waste when used with the larger 300 facial tissues boxes. The manufacturer for a slight increase in the cost for the added cardboard increased the height of the 150 facial tissue box to now contain 300 facial tissues and for a slight cost increase they now sold double the number of facial tissues. Some manufacturers have even linked the tissues together with four small "links" in the cut between sheets to prevent "fall back" inside the boxes but this has caused an annoyance in that the tissues sometimes come out as a linked chain of tissues and the sheets do not separate as expected. However, the 300 tissue box never did perform as well as the 150 or 175 tissue box in regard to convenience and economy for the buyer and has been the cause of annoyance and waste of tissues, unused by yet discarded by the user.

An object of this invention is to provide a dispenser which will work with a number of folded sheet products and work equally as well with folded facial tissues and folded paper towels or other folded sheet products. Both, a standard disposable cardboard dispenser or a refillable molded plastic dispenser, which will be new and novel will control the folded sheet as it is removed from the end opening of the dispenser and the folded sheet shall be controlled inside the container, in the manner in which they are removed, by the internal control plate inside the dispenser. The control plate will only allow one folded sheet to be removed at any one time which then causes the next succeeding folded sheet to "pop-up" and protrude through the end opening of the dispenser. The sheet protrudes a set amount by which it can be easily removed by the user and the cycle is repeated with each folded sheet removed. The horizontal friction between the inter ply layers of the folded sheets is controlled by the top control plate which allows the next folded sheet to protrude through the end opening when any one protruding folded sheet is removed. When the sheet is removed from the end opening of the dispenser it can be drawn directly out from the end in a horizontal direction or slightly upward at a somewhat vertical angle or up vertically from the end of the dispenser through the top part of the end opening for removal of the folded sheet by the user.

A further object of the invention is to allow the remaining folded sheets in the dispenser below the control plate to be visible which will then indicate to the user then the folded sheets in the dispenser are depleted. The end opening also allows the user to remove a set count of folded sheets through the end opening which then become a set packet of folded sheets which can be taken an used elsewhere.

A further object of my invention is to combine the advantages of the end opening in the dispenser with the control features of the internal control plate to allow the same standard size disposable tissue boxes to be used on the same existing manufacturing lines which will result in a disposable dispenser for 300 count facial tissues where the tissues will only be allowed to be removed one tissues at a time to the very last tissue. When the folded sheet or facial tissue is removed towards the vertical it lifts the cardboard control plate as well as it moves horizontally under the control plate to allow a very light control plate of 12 to 14 grams to control the facial tissue as it is withdrawn in order that the next successive tissue will not be withdrawn an excessive amount. With the molded cardboard control plate because of the naturally rough undersurface it can be of a lesser weight than the smoother molded plastic control plate. The weight and the undersurface roughness of the control plate are critical factors over the distance the folded sheet projects and a minimum projection of 1½" is desired.

And a further object of my invention is to further combine the advantages of the end opening with the control features of the internal control plate to allow these features to be used in a refillable, molded plastic, dispenser in a free-standing mode or in a horizontal attached dispenser mode or in the pull-out or hopper drawer design from the front support flange and in a supported front filling folded sheet container with a front opening plate.

And a further object of my invention is to create a process by which the folded sheet packets at the end of the production line may before or after they are cut to length be compressed in height and the folded sheet packet then restrained by a wrapper or bag with an integral carrying handle thereby saving shipping and warehouse costs and costs to the environment.

And a further object of my invention is to create a bulk pack of compressed folded sheet packets in pre-determined multiples wherein refillable, molded plastic, dispenser is placed within the poly bulk wrapper and over one and part of a second folded sheet packet with the control plate and the removable bottom placed between the packets in a horizontal or vertical position in order that the refillable dispenser is shipped and packaged and sold at a reduced cost with the packets of folded sheet products, as an economical and convenient bulk pack.

And still a further object of my invention is to design the refillable, molded plastic, free-standing dispenser to be fitted with Velcro pads (VELCRO CANADA INC.), in predetermined locations which then can be used to attach the dispenser to the fabric or floor mats of an automotive type vehicle. Permanent attachment locations are also provided in the same detachable bottom when the dispenser is to be located and securely attached in an automotive vehicle or similar structure and also when secured to a motel/hotel vanity or similar structure to discourage theft of the dispenser and the folded sheet products within the dispenser.

And still a further object of my invention is to create a dispenser for automotive or similar use where the dispenser is pulled out as like a drawer or hinged open like a hopper drawer in which the folded sheets in a packet or those removed from a conventional cardboard dispenser may be placed in the open back end of the dispenser. The folded sheets would be used from the conventional cardboard boxes for the open front or drawer type dispensers when the manufacturers perforated the box where it could be cut apart in two halves as shown. A molded plastic half-box of the same size would contain the folded sheets from a compressed packet. With the drawer dispenser replaced it will then allow the folded sheets to be removed one sheet at a time from the front end opening of the dispenser. The dispenser of refillable, molded plastic design would be attached to a flange to the face of a support structure in the automotive vehicle or to a motel/hotel vanity, where it would be face mounted or supported in a horizontal position wherein the folded sheets would be removed by the user.

And still a further object of my invention is to have a dispenser with an end vertical opening where the folded sheets are removed horizontally and where the dispenser will also have the end vertical opening extend up and into the front top part of the dispenser where it allows the folded sheet products to be removed vertically as well as in a horizontal direction wherein the end opening aligns itself with the front elliptical opening in the internal control plate which then allows the folded sheets to raise up into this opening when the dispenser is first used and when it is "filled" to capacity with folded sheets. Also when the folded sheets in the dispenser are almost depleted they are removed in a somewhat vertical direction, one at a time. Then the end opening of this invention allows the control plate to control the folded sheets and their removal to the very last sheet in the dispenser when the last few folded sheets are removed in a somewhat vertical direction.

(V) BRIEF DESCRIPTION OF THE DRAWINGS

The invention will now be described merely by way of illustration with reference to the accompanying drawings in which.

(VI) DESCRIPTION OF THE PREFERRED EMBODIMENTS

Figure 1:
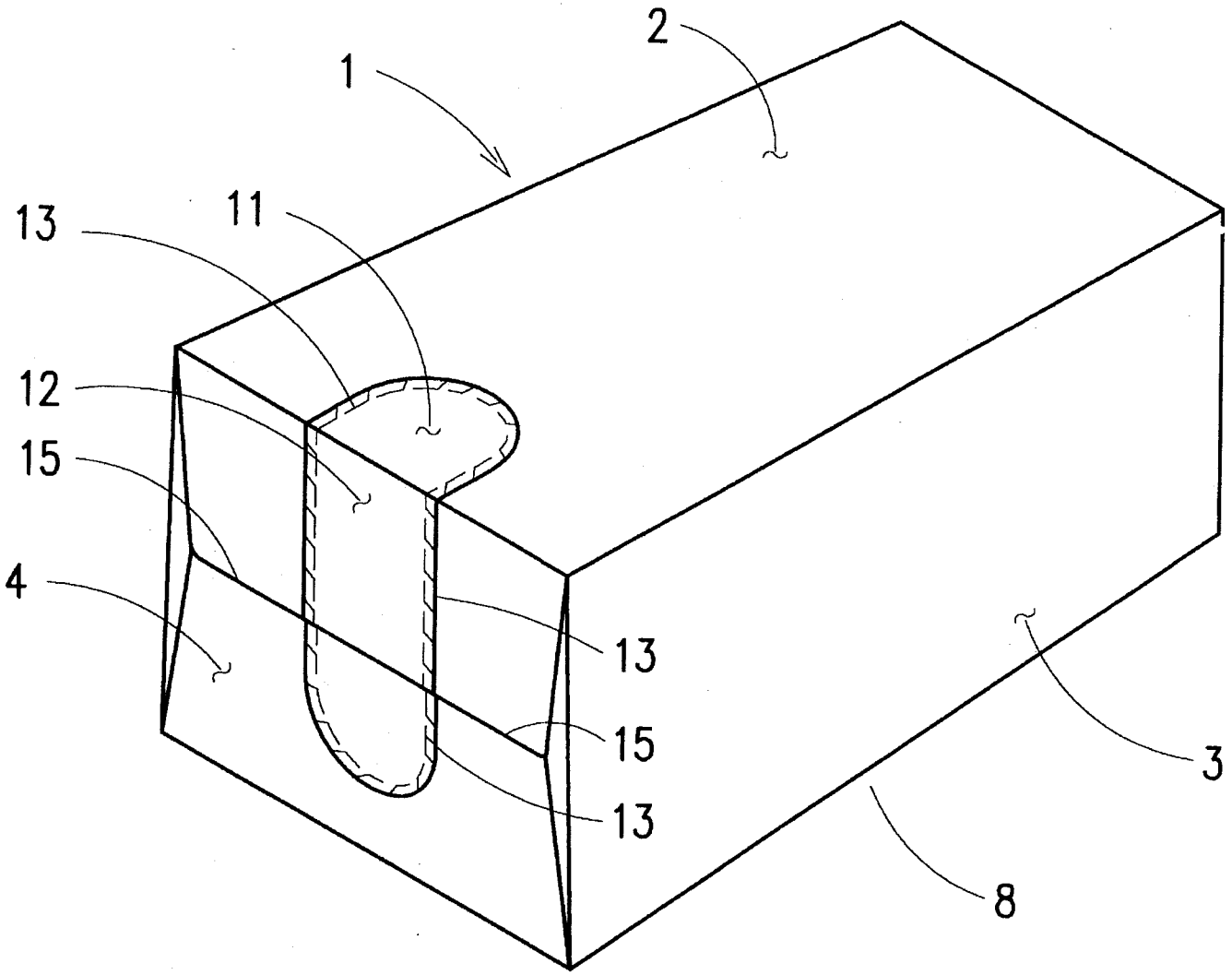
FIG. 1 is a perspective view of the exterior of the folded sheet dispenser when used as a disposable cardboard box dispenser for facial tissues or other sheet products showing the removal and perforated end panel at the end opening.

Referring now to the drawings, a first embodiment of an end dispensing, disposable, folded sheet dispenser, constructed in accordance with my invention is shown in FIGS. 1 through 4.

Referring first to FIG. 1, there is indicated therein generally one embodiment of this folded sheet end opening dispenser in accordance with this invention. The device 1 includes a disposable cardboard dispenser container in a familiar box shape and made of disposable but recycled cardboard. The physical shape of the container would not be unlike the size of the folded sheet dispensers which now dispense facial tissues through their familiar top oval opening as we use today in the convenient sheet counts of 150, 175 or 300 facial tissues. The same known technology to cut and form the cardboard box as is used today would be used to create this new and novel disposable dispenser with a unique end opening 6 which is shown with a removable end cover panel 12 where it also extends 11 up into a top 2 of the dispenser 1 and where a removable panel perimeter is perforated 13 for ease of removal by the user from a box end 4 and top 2 of a dispenser. A opposite sides 3 of the box and a closed bottom 8 are made with known cardboard box forming technology.

Figure 2:
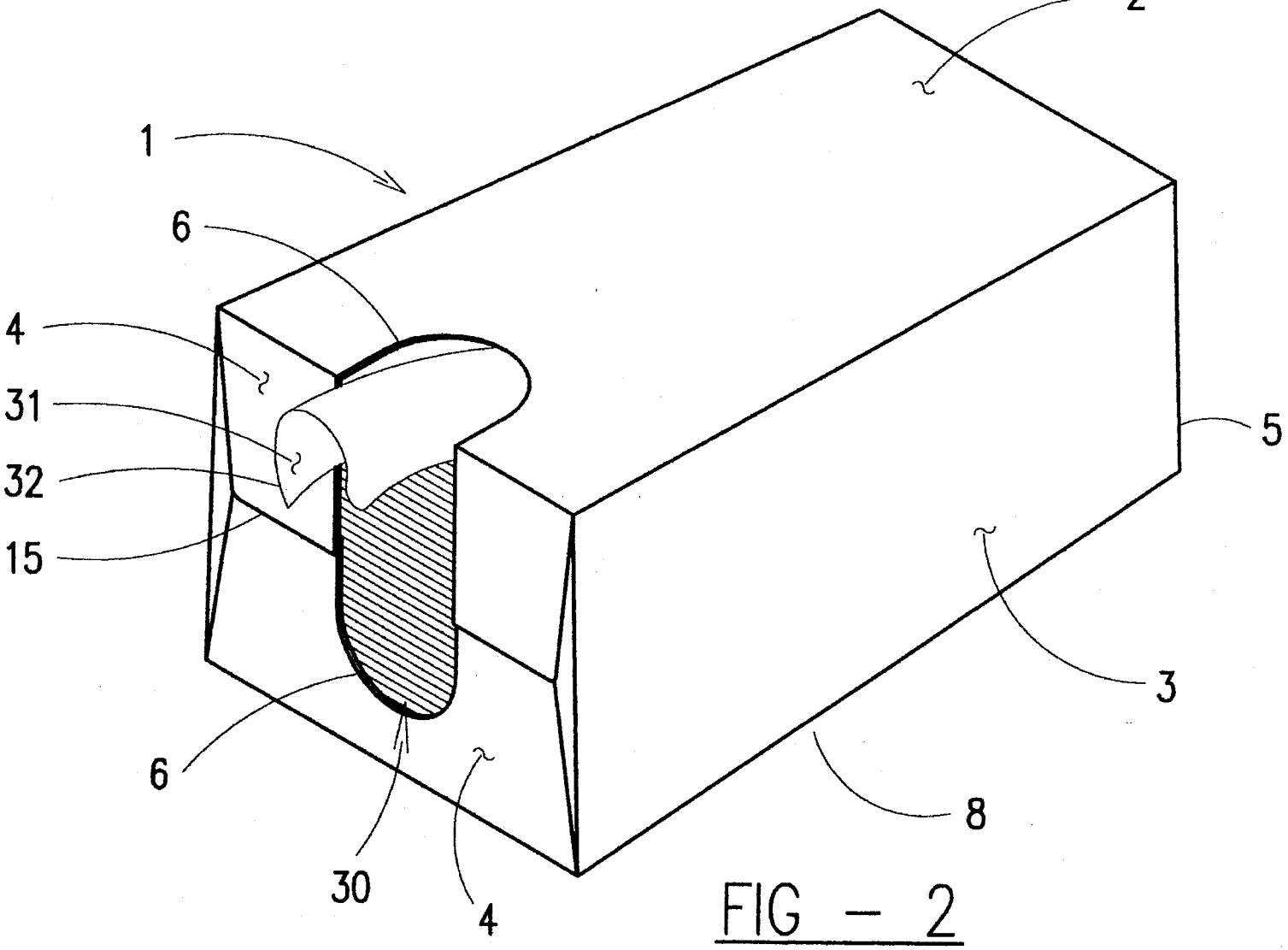
FIG. 2 is a perspective end view of the folded sheet disposable cardboard dispenser when used for facial tissues or other sheet products with the perforated end opening closure removed showing the internal top control plate resting on the facial tissues inside the cardboard container with one tissue protruding through the end opening.

Referring now to FIG. 2 which is an isometric view of the disposable end opening folded sheet dispenser 1 where an end panel 12/11 of FIG. 1 has been removed to show a sheet 31 which has been partly withdrawn from an end opening 6 in an end wall 4 of the dispenser 1 where when the user pulls on an end 32, of the projecting folded sheet 31, a folded sheet pulls out from under an internal control plate 20 where it moves from side to side from under the control plate 20 and extends upward through a front elliptical cut-out 23 of the control plate and from under a parallel edge 27 of the control plate, which floats on the topmost folded sheet.

Figure 4:
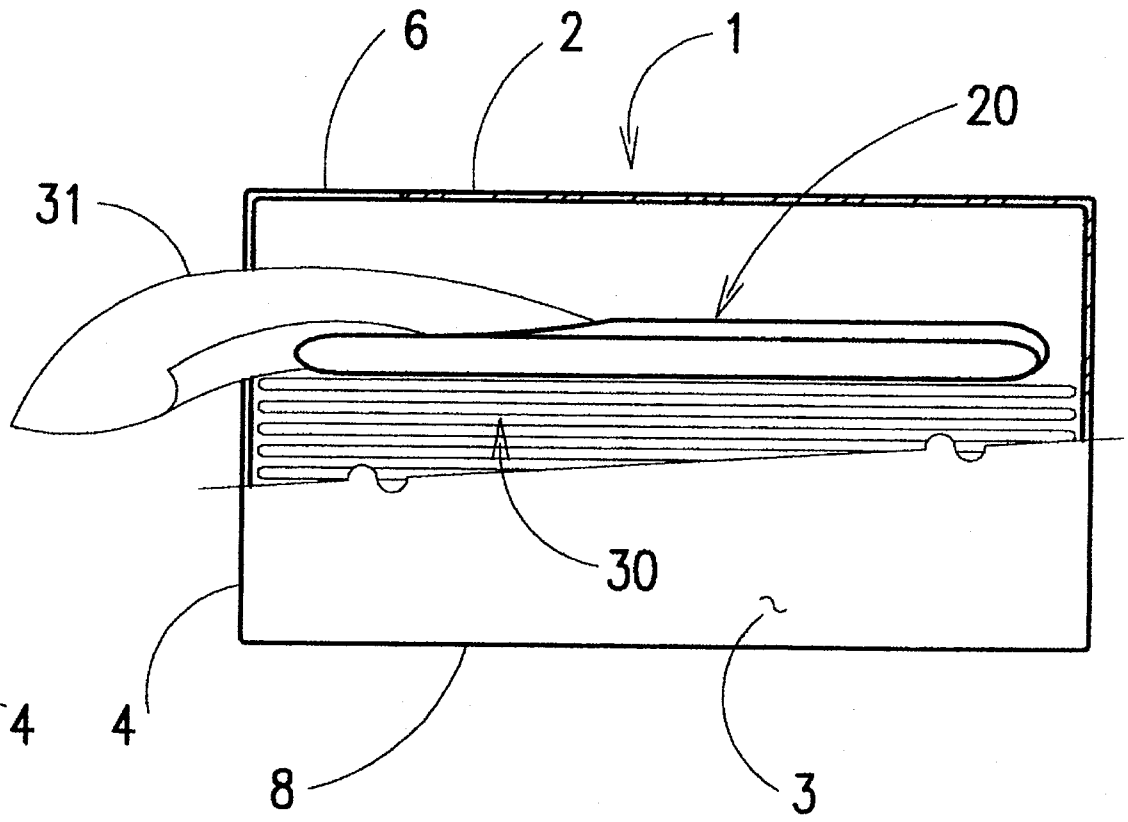
FIG. 4 is a sectional side view of the folded sheet disposable cardboard dispenser where the folded sheets are shown with the top control plate resting on the folded sheets with one sheet protruding through the end opening.
Figure 3:
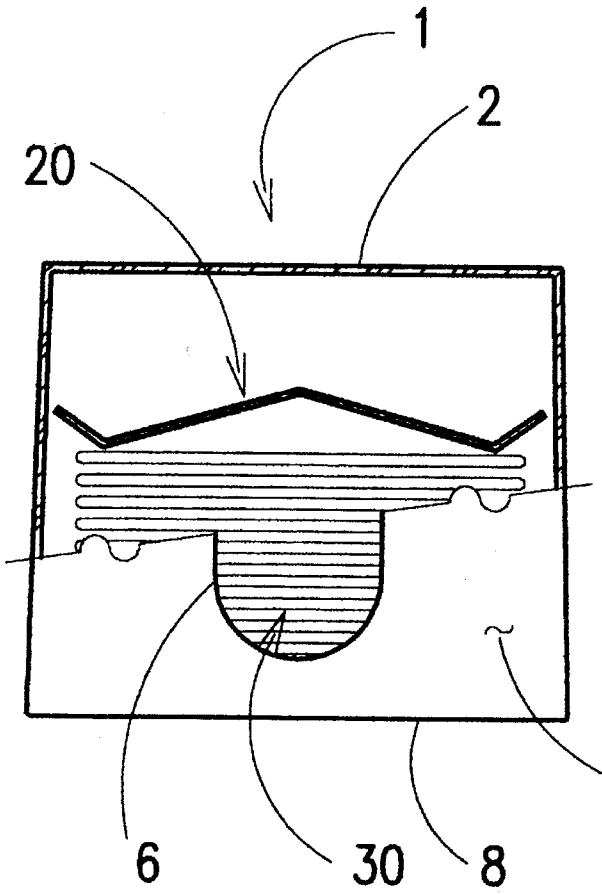
FIG. 3 is a sectional end view of the folded sheet disposable cardboard dispenser showing the internal folded sheets and the top control plate.

Referring FIGS. 3 and 4 of my first embodiment of this invention a folded sheet 30 is shown inside a cardboard box 1 of the disposable dispenser in the end and side view of the cardboard dispenser where a control plate 20 is shown resting on a folded sheet packet 30 and which shows the folded sheet protruding out from under the control plate. The details and construction of the simple cardboard box dispenser 1, as shown here in numbers 2 through 8, which emphasizes the simplicity of the end opening dispenser when constructed of low cost cardboard.

Figure 5:
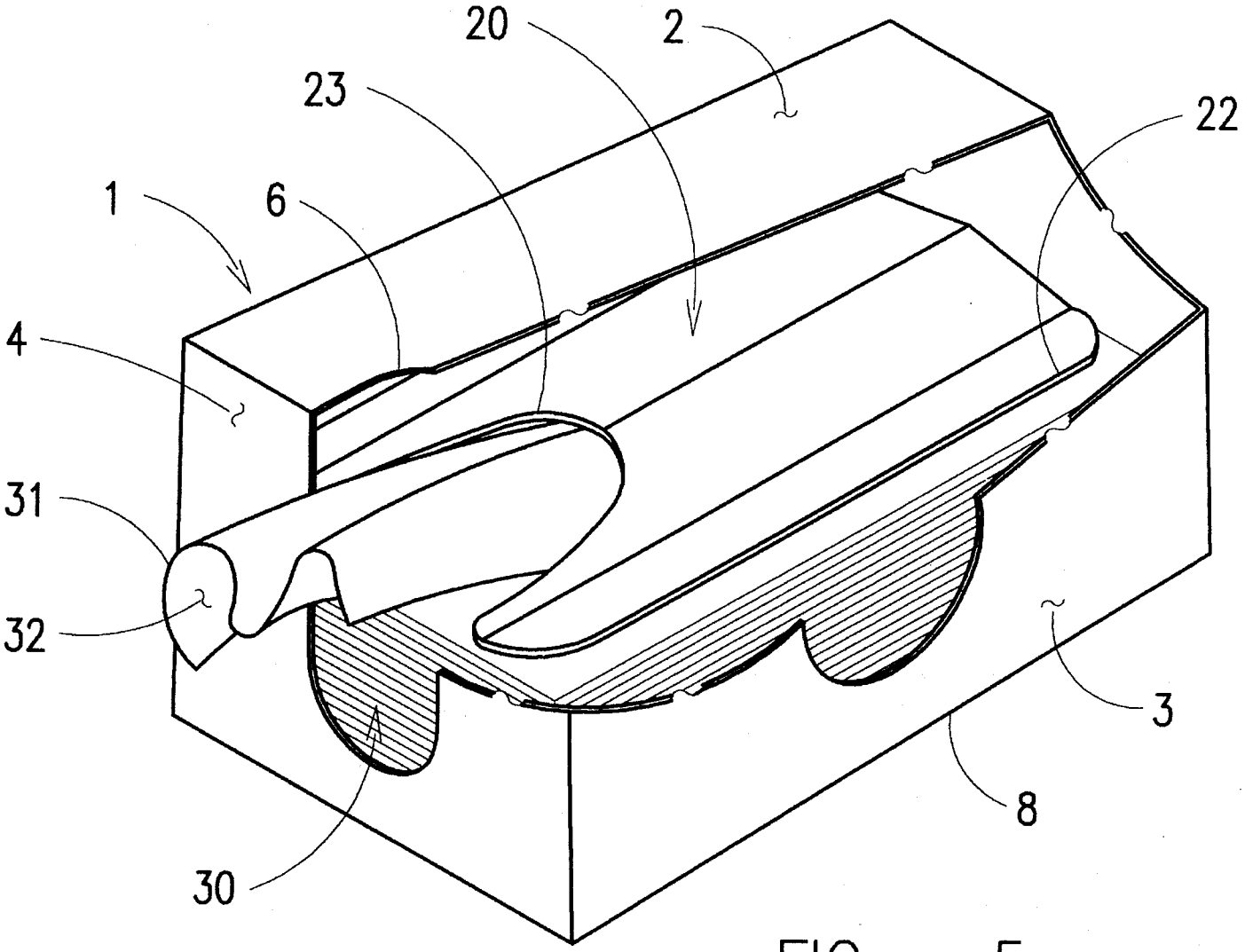
FIG. 5 is a perspective view of the exterior of the folded sheet dispenser as a refillable, molded plastic, free-standing dispenser. The sectional cut away shows the internal control plate and tissue packet.
Figure 6:
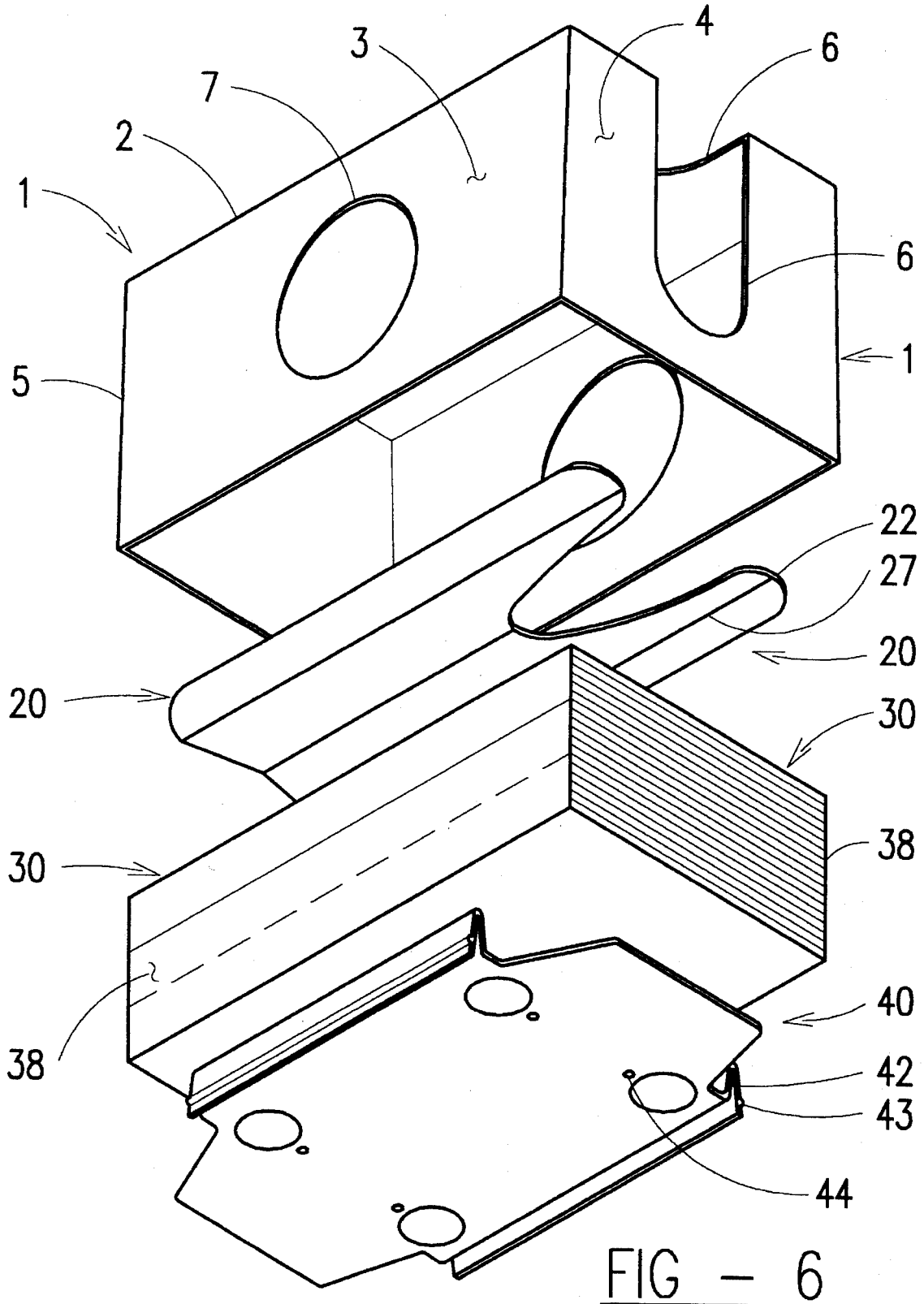
FIG. 6 is a exploded vertical view of the various components of the folded sheet free standing dispenser when constructed as a refillable, molded plastic, dispenser.

A second embodiment of this invention is as illustrates in FIGS. 5 and 6 of a free-standing refillable folded sheet dispenser 1 of injection molded plastic. Preferably formed of thermoplastic material such as polypropylene wherein the body of the dispenser 1 is of a unitary molded plastic design, with the same physical shape and dimensions of the first embodiment but with an expected three to five year life span where a compressed folded sheet packet 30 is placed inside the dispenser 1 by the user and held in place by a snap-in bottom 40. Where with my first embodiment the folded sheets were placed inside the cardboard dispenser at the production plant in their existing automated production line. Herebefore, it was never possible to compress the folded sheets inside a disposable cardboard dispenser in that the compressed sheets would be torn and damaged and made unusable when they are first removed by the user. Now, in my invention, with a refillable molded plastic dispenser, where the dispenser can be of a predetermined size to accept the folded sheets which are released from a compressed packet of folded sheets it is now possible to compress the sheets at the end of the production line with a 20% or more, reduction in the folded sheet packet. The reduced volume of the folded sheets will provide a saving in shipping and warehousing costs which are reflected by this volume reduction of the folded sheets in the compressed packet. A saving in retail store space and the costs for the cardboard disposable boxes, now not required, would mean additional direct savings to the environment, energy costs, and landfill costs as well as the saving in the trees themselves to provide the cardboard for these disposable cardboard dispensers would be substantial. The refillable free standing dispenser of this second embodiment as detailed in FIG. 5 is of a molded body with a vertical end opening 6 which may extend up into a top 2. The folded sheets are more easily removed and are controlled by an internal plate 20 which is as shown rests on the topmost folded sheet inside a dispenser 1 and controls the friction between successive layers 33 of the interlayered and interleaved C-Folded sheets. The layers of the folded sheets are shown in a side port 7 and at a vertical end opening 6 which allows the user to select a set number of folded sheet layers 33 to be separated and removed as a small pack of folded sheets.

As depicted in FIG. 6 of my second embodiment of the refillable dispenser the components of the free-standing molded plastic dispenser are shown in their vertical exploded view where the body of a dispenser 1 is of molded plastic with an end opening 6 shown in an end 4 of the dispenser body in which is placed a top control plate 20 which floats on top of the top sheet of a folded sheet packet 30 which is shown in the compressed and restrained state by a wrapper 38 which is removed before it is placed in the dispenser. The packet is supported in place by a snap-in bottom 40 which locks in place by live hinge side bars 42 with a release bar 43. Protective felt pads 45 may be located where the dispenser is used on a finished surface and also Velcro pads (VELCRO CANADA INC.) may be placed on the bottom late of the dispenser if it is to be used on the fabric inside an automotive vehicle. Holes 44 shown in the base plate are for attachment screws for the base to a motel/hotel vanity to prevent theft. For rigid attachment, inside an automotive vehicle, screws are used at pre-engineered locations in the bottom attachment base of the free-standing, refillable, molded plastic, dispenser.

Figure 7:
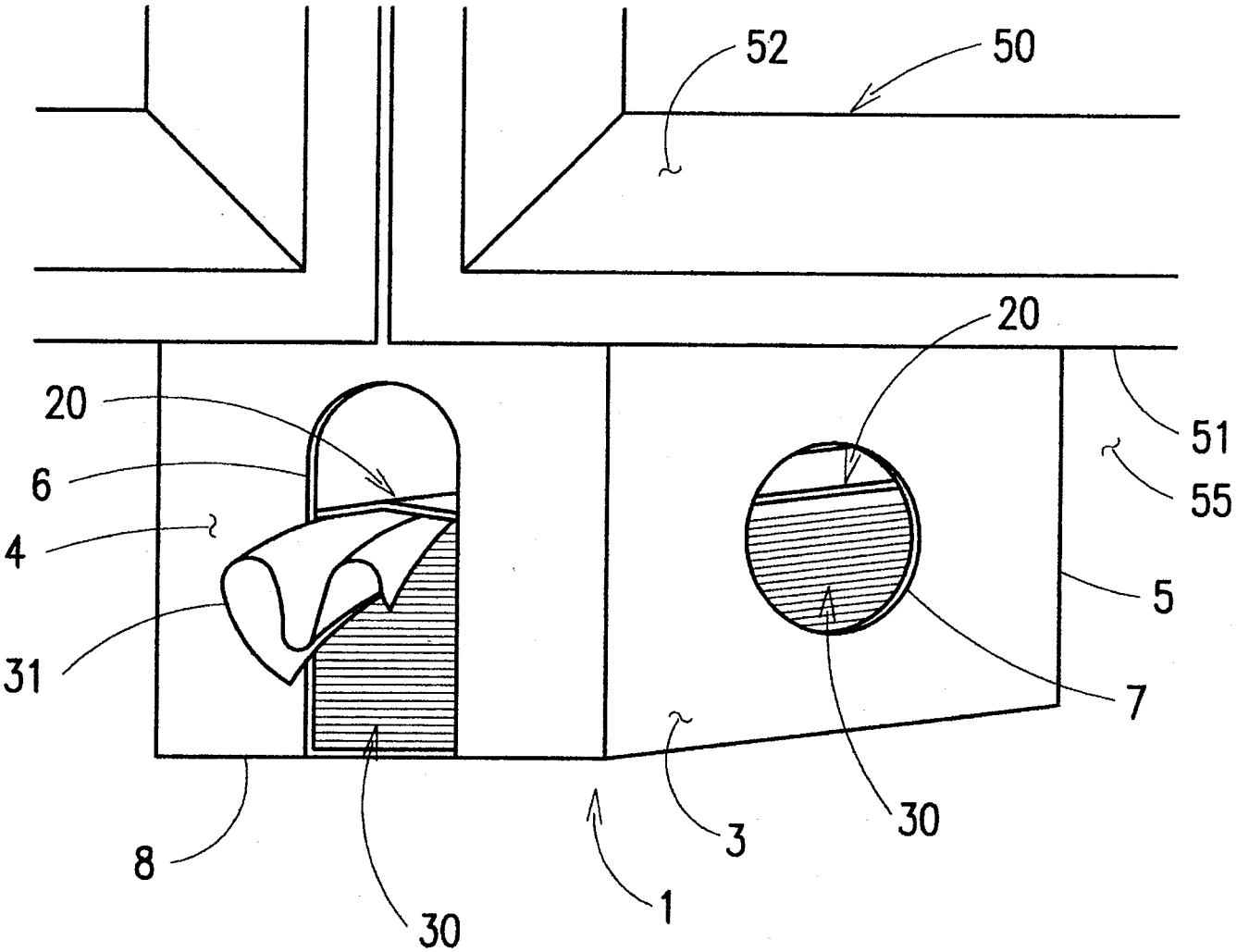
FIG. 7 is a perspective view of the refillable, molded plastic, folded sheet dispenser when mounted horizontally underneath a support structure.

A third embodiment of this invention is as illustrated in FIG. 7 of a refillable, molded plastic, folded sheet dispenser 1, wherein a body of the dispenser is not unlike the second embodiment of my invention as previously described except that the dispenser 1 is horizontally attached to a unique support plate 40 on the underside of a support structure 50 similar to a kitchen top cabinet. It would contain a folded sheet packet 30 and an internal control plate 20 where a folded sheet 31 protrudes through a vertical end opening 6 in an end 4 of the dispenser body 1, where it is removed by the user. The interply friction between the folded sheet layers causes the next successive folded sheet to protrude through an end opening 6 which then repeats the cycle.

Figure 9:
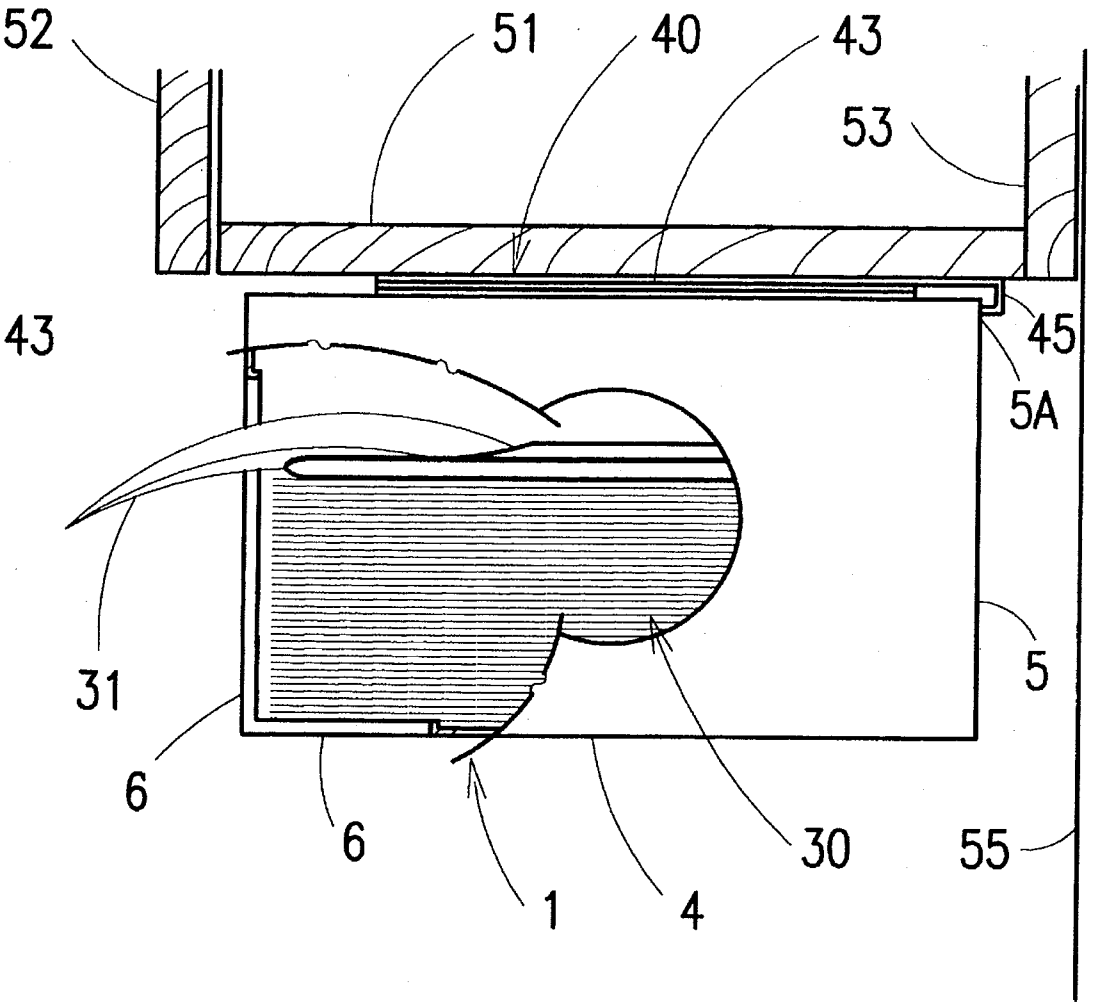
FIG. 9 is a side view of the horizontal attached sheet dispenser of a refillable, molded plastic, material mounted on the hinged attachment plate.
Figure 8:
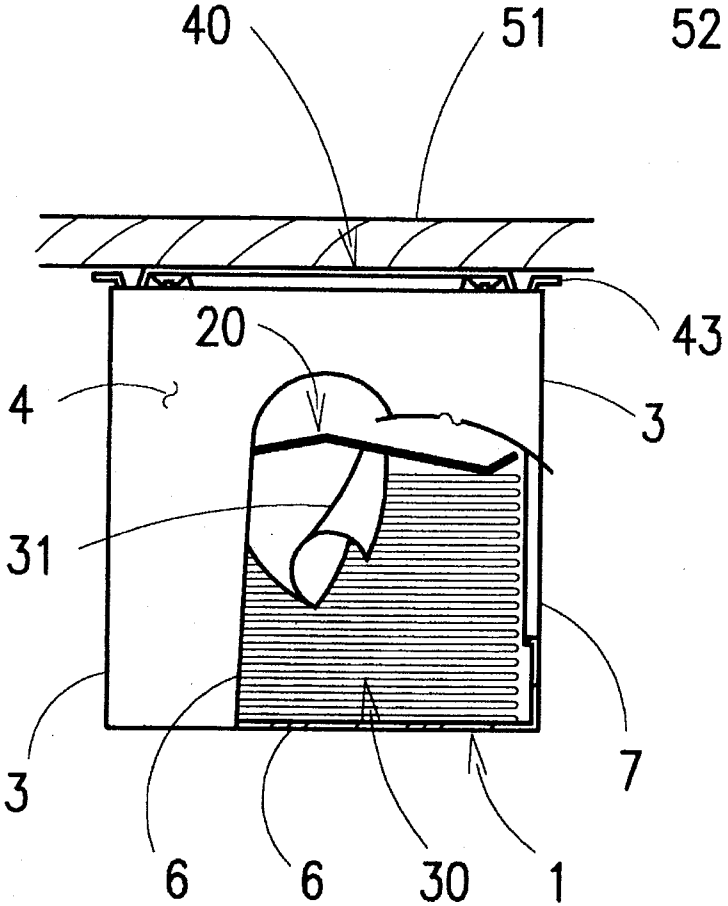
FIG. 8 is an end view of the refillable, molded plastic, folded sheet dispenser showing the bottom attachment plate secured to the underside of a support structure similar to a kitchen top cabinet.

FIGS. 8 and 9 of the refillable, molded plastic, dispenser are of the end and side view of a horizontally attached third embodiment of my invention which details a dispenser 1 with a projecting folded sheet 31 extending through an end opening 6 of the dispenser which is shown mounted at right angles to a support structure 50 by an attachment plate 40 where it is held in place by a snap-in place side bars 42/43 and where the body of the dispenser 1 is attached by a rear hinge 45, of a attachment plate 40, through an end slot 5A which allows a dispenser 1 to be quickly and conveniently hinged down when side bars 42/43 are released. The dispenser 1 is then completely removed from the attachment plate 40 and an internal control plate 20 is also removed and the dispenser can be then washed and dried for cleaning before a new packet 30 of folded sheets is then placed within the dispenser. A control plate 20 is replaced on the topmost layer and the dispenser is again placed over a rear hinge 45 and snapped up in place and restrained by side release bars 42/43 and then the dispenser is ready for use. A folded sheet is then removed horizontally and not somewhat vertically as with the free-standing dispenser.

Figure 10:
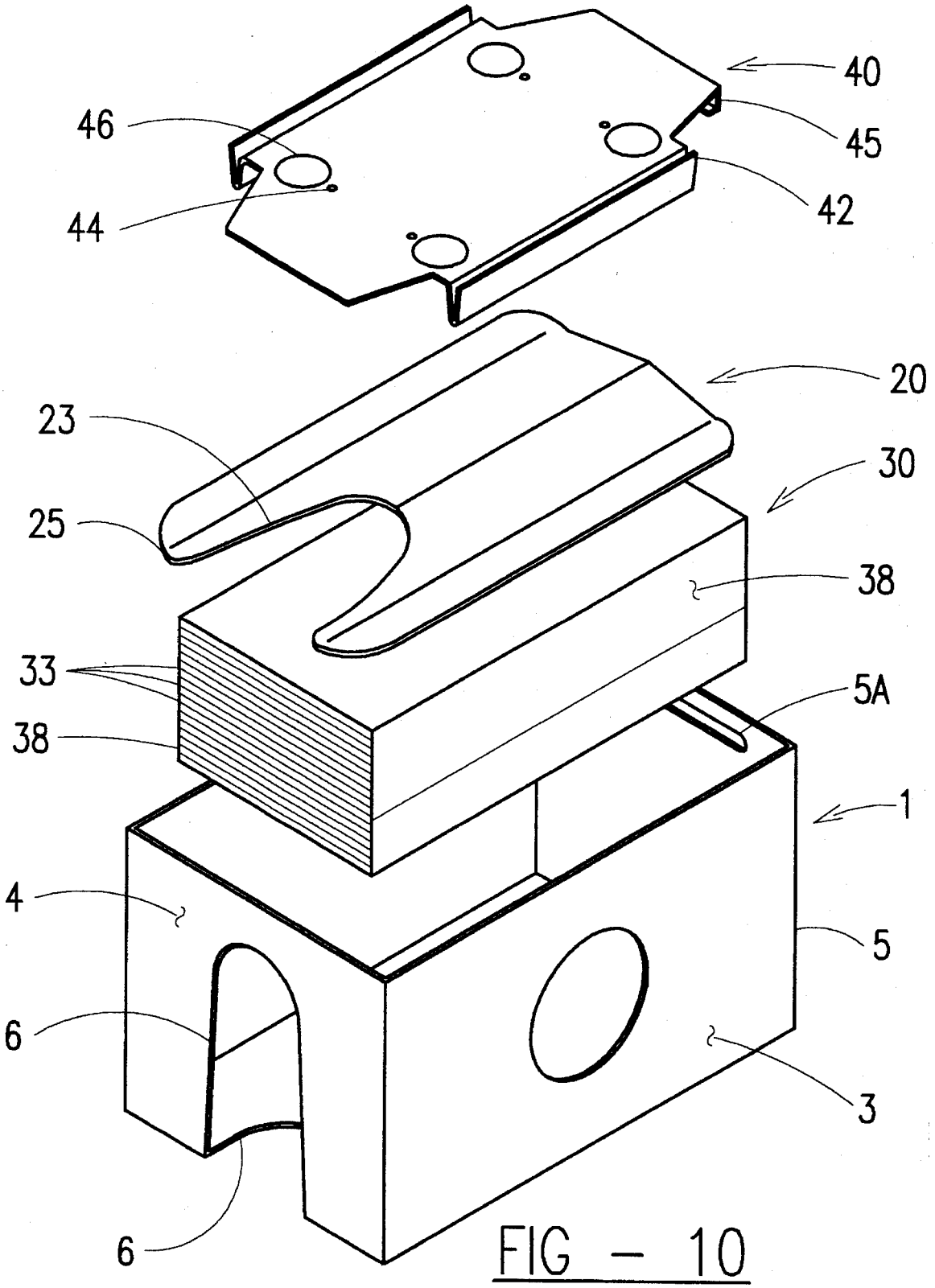
FIG. 10 is a vertical exploded view of the components of the and horizontally attached folded sheet refillable dispenser.

FIG. 10, of the drawings, is an exploded vertical isometric view of a third embodiment of my invention, a horizontally attached dispenser, which details the components with a top attachment plate 40 with a rear hinge 45 and side release bars 42/43 where an internal control plate 20 is placed on top of a folded packet sheet 30 after a restraint wrapper 38 is removed and the folded sheets are then placed inside the dispenser 1 with an end opening 6 and a rear hinge slot 5A is conveniently placed over a rear hinge 45 when the dispenser is moved up and snapped in place.

Figure 11:
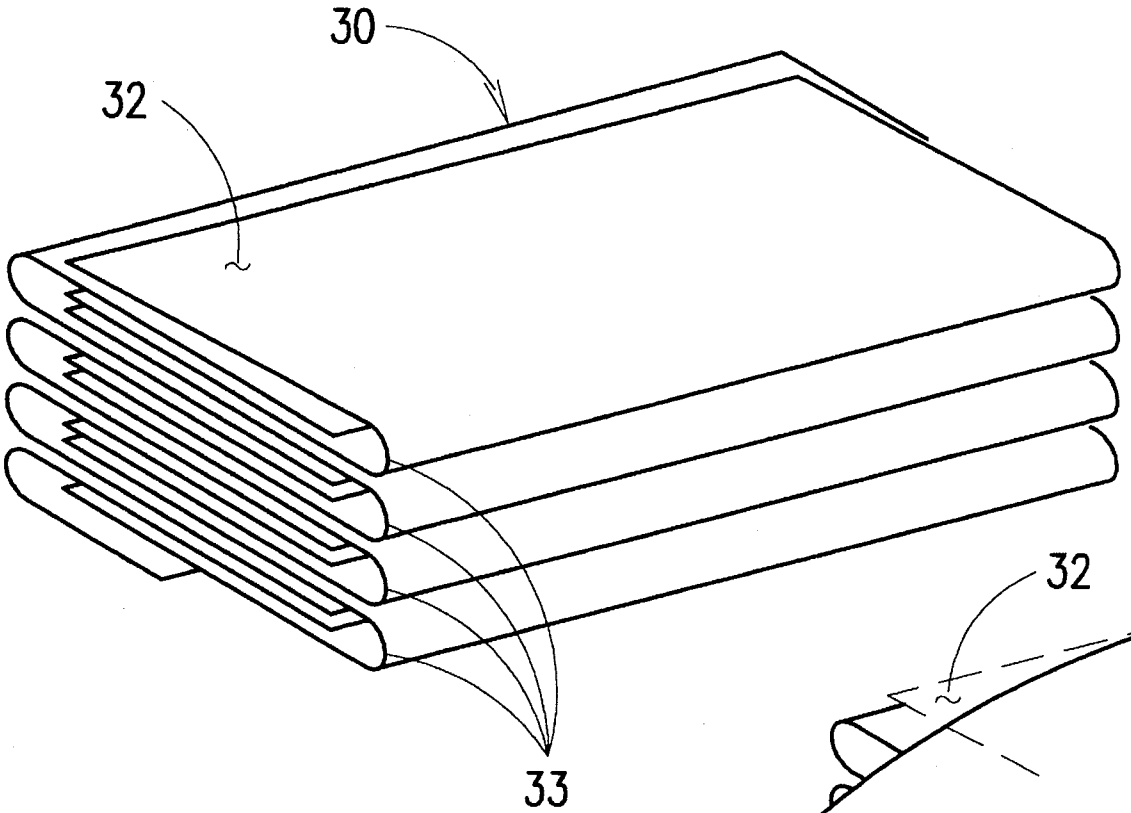
FIG. 11 is an isometric view of the folded sheet products which would be used inside the refillable dispenser and the disposable cardboard dispenser.
Figure 12:
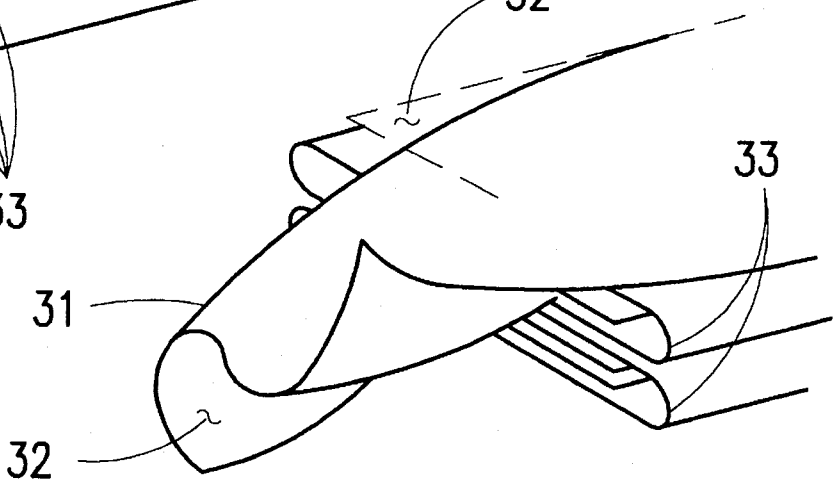
FIG. 12 is an isometric end view of the same folded sheet products where one of the folded sheets is being removed.

FIGS. 11 and 12 of the drawings are of the folded sheet packet in isometric view and are common to all embodiments of my invention in that the packet of folded sheets can be used in the disposable cardboard dispenser and as well as in the refillable, molded plastic, dispenser. This same C-Folded pack of folded sheets are the same as the folded sheets used by the industry with the conventional top oval dispensers used for folded facial tissues. A folded sheet packet 30 is composed of interfolded and interleaved sheets 33 of a set width and as a set count to result in a height 30H where a top corner 32 of the folded sheet is pulled out through the end opening to result in a protruding folded sheet 31 which is controlled by the friction between the interlayers 33 of the sheets in the horizontal 30L direction of the folded sheet packet.

Figure 14:
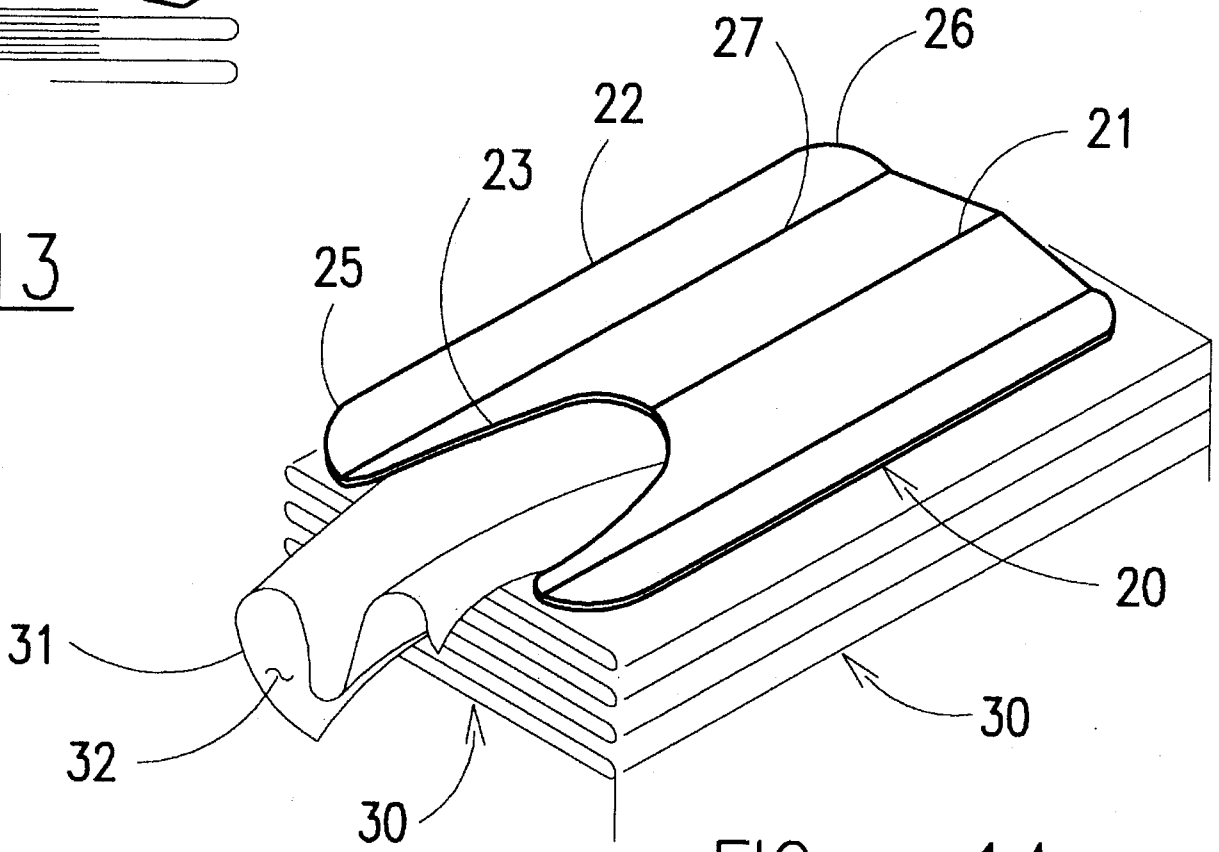
FIG. 14 is an isometric view of the folded sheet products where the control plate rests on top of the uppermost sheet.
Figure 13:
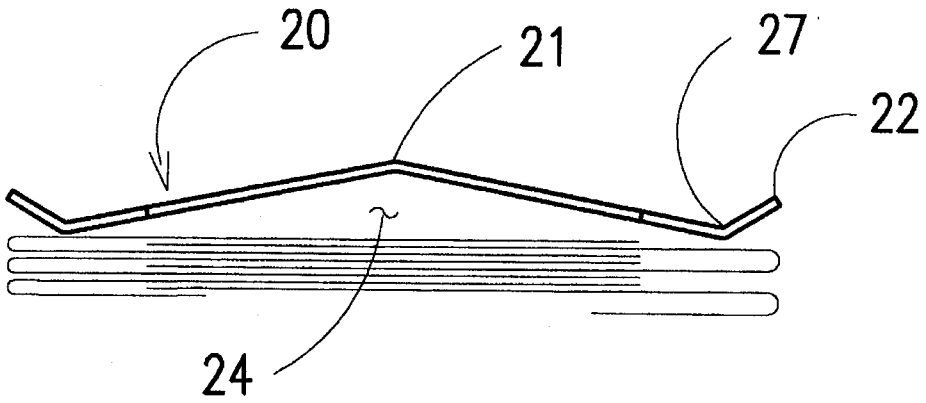
FIG. 13 is an end view of the folded sheet products with the control plate resting on the top most sheet.

FIGS. 13 and 14 of the drawings are of an internal control plate 20 which is common to all embodiments of my invention in that the control plate 20 floats vertically on a packet 30 of folded sheets where in a space 24 created under the control plate 20 and between the top ply of folded sheets allows the folded sheet to be released from under two parallel outer edges 27 of the control plate 20 and the sheet flows towards a crowned centerline 21 where the folded sheet is then removed from under the control plate 20 and through a front eliptical cut-out 23 which allows it to protrude 31 through an end opening of the dispenser where front corners 25 rest against a dispenser front end wall as the folded sheets lift an opposite end 26 of the control plate as the folded sheet is withdrawn. The outer edges 27 are textured with molded serrations on the underside and next to the surface of the top tissue. This textured treatment gives further control over the projection of the succeeding tissue as it is withdrawn by the top tissue. A front cut-out 23 and a crowned centerline 21 of the internal control plate 20 are the preferred manner in which this invention controls the succeeding folded sheets as one folded sheet is removed automatically it causes the next folded sheet to be drawn out through the dispenser by the interply friction between the layers of the folded sheets. Although a somewhat differently shaped control plate would result in a degree of control over the removal of a folded sheet it was found by experimentation that the greatest degree of control was from the shape of the control plate shown in these drawings. Also with the third embodiment of my invention where the folded sheets removal was horizontal, the front cut-out in the control plate was found not to be as necessary. Therefore, although other shaped control plates may work to exercise a limited degree of control over the folded sheets under certain conditions, the control plate as taught in my invention was found to exercise the greatest control under the embodiments described.

Figure 14A:
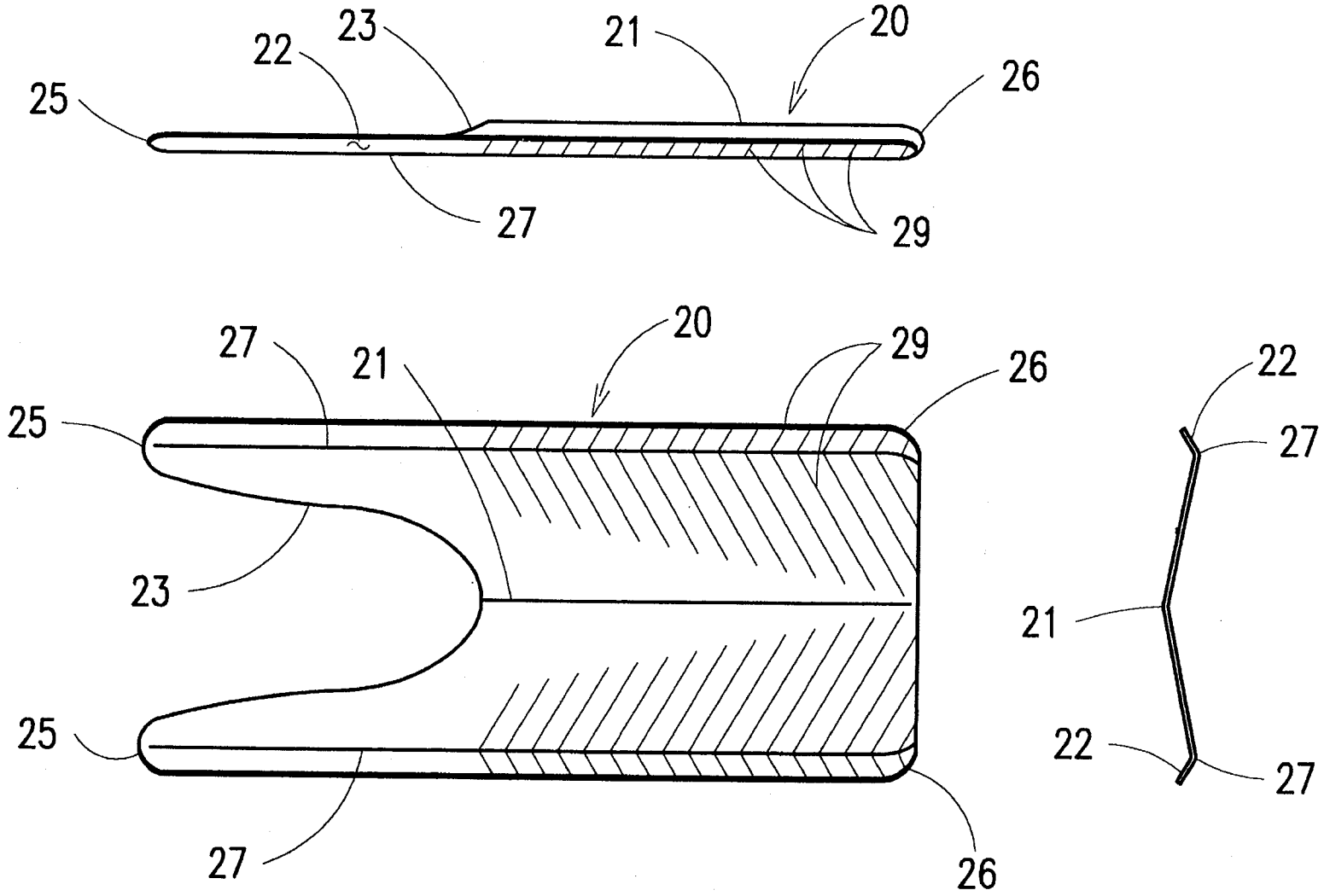
FIG. 14A is a view of the undersurface of the molded cardboard or the molded plastic control plate showing the textured surfaces.

FIG. 14A is of a under surface 29 of a control plate 20 as with a press formed, impregnated card board, and as with a molded plastic control plate, a under surface 29, is in direct contact with a top folded sheet. A control plate is textured by machined ridges 29 in the plastic molds and by machined ridges 29 in the male press die which impresses the ridges 29 in the impregnated card board of a disposable card board control plate.

Figures 15, 16, 17:
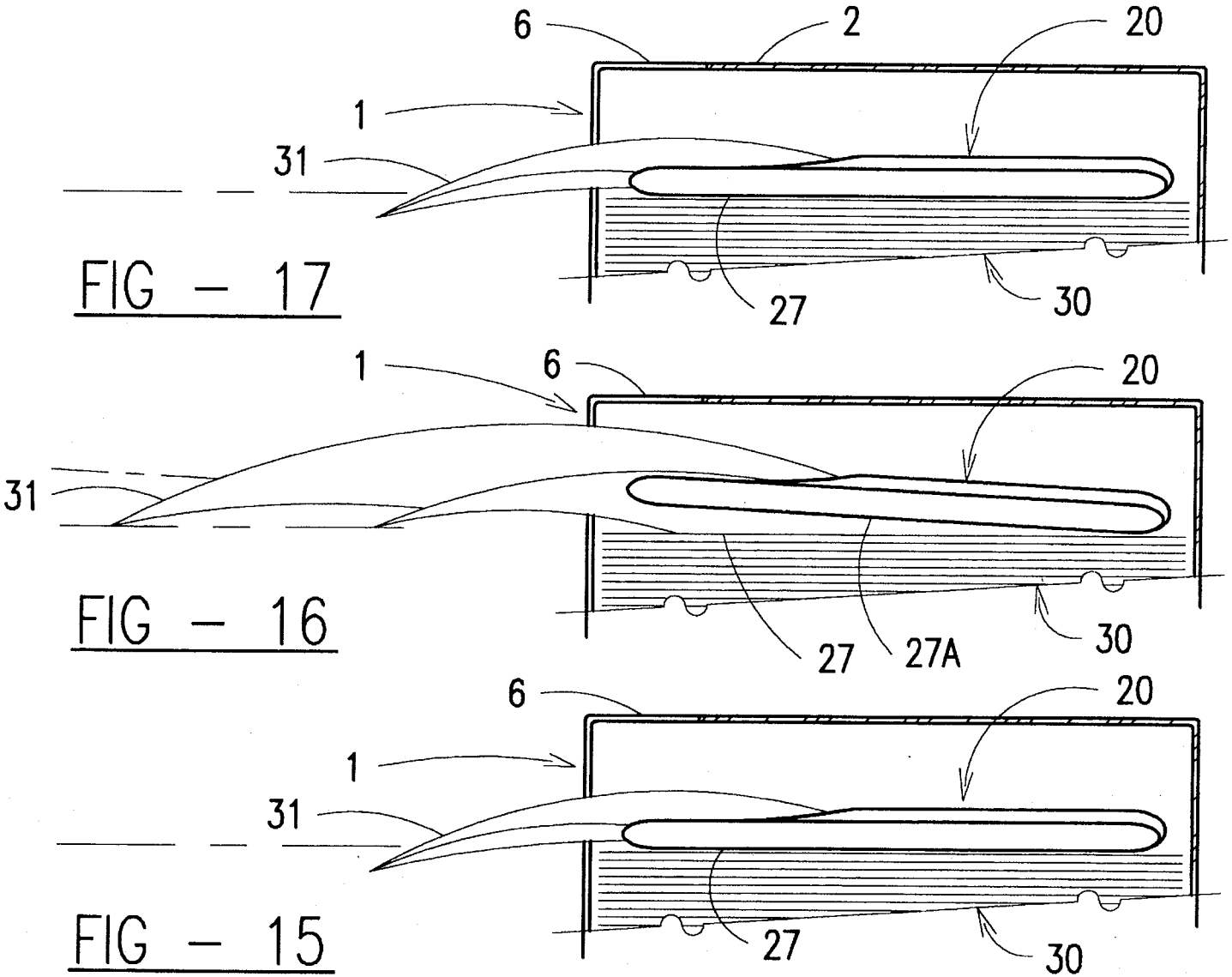
FIG. 15 is a sectional side view through the disposable or refillable folded sheet dispenser wherein the folded sheet is partially withdrawn and ready to be removed.
FIG. 16 is a sectional side view through the disposable or refillable folded sheet dispenser where the extended sheet is almost removed and it draws the next sheet partly through the end opening.
FIG. 17 is a sectional side view of the disposable or the refillable dispenser where the folded sheet product protrudes through the end opening after the preceeding extended sheet is removed.

Again in FIGS. 15, 16 and 17 of the drawings is a sectional side view of either dispenser as outlined in our previous embodiments which is common to my invention and depicts the action of a control plate 20 as it floats on a top folded sheet 31 and controls the horizontal friction between the layers of a interfolded sheet 30 as a folded sheet 31 is withdrawn through an end opening 6 of the dispenser. The withdrawal of a folded sheet from under the control plate 20, as shown in FIG. 15, as it is ready to be withdrawn, proceeds through to FIG. 16 and then the cycle is repeated in FIG. 17. Again, a next consecutive sheet 31 protrudes through an end opening and where a oscillating control plate 20, FIGS. 15 through 17, control the withdrawal of the folded sheet through an end opening 6 in that the distance a folded sheet 31 projects beyond an end opening is controlled by the design and weight and textured underside of an internal control plate.

As a folded sheet 31 in FIG. 15 is withdrawn as shown in FIG. 16 from under a control plate 20 a folded sheet 31 pulls a next successive folded sheet 31B up and out from under a control plate 20 by the horizontal friction between the layers which then elevates a control plate 20 to cause it to move vertically from front to back 27/27A as a folded sheet 31 is withdrawn. An internal control plate 20 rests on the top folded sheet in a horizontal position 27 and moves vertically 27A as the next folded sheet is withdrawn. The rear portion of a control plate 20 would also move vertically (not shown) as the between ply friction of a folded sheet would cause the next consecutive folded sheet to be withdrawn from under the control plate, from the outer edges, toward the crowned centerline of the control plate 20. A control plate 20 then moves horizontally from the rear to the front of the dispenser where it is free to slide on the top layer of a folded sheet packet 30. Front corners 25 restrain the control plate 20 at the inside front corners of the dispenser at opposite sides of a vertical front end opening 6 of the dispenser. Then as a folded sheet is next withdrawn a control plate which rises vertically also slides back to the rear wall of the dispenser and then moves forward again as a folded sheet is totally withdrawn. The weight of a plastic control plate when sheets were withdrawn horizontally was found to be from 15 to 20 grams and when a sheet was withdrawn somewhat vertically it was found from experimentation that a control plate could be somewhat lighter at 12 to 15 grams. It was also found, from later experimentation, that the underside of the plastic control plate could be scored with grooves or serration's which would be opposed to the direction in which the sheets would be withdrawn, to further control the projection of the folded sheet or tissue through the front opening of the dispenser, when removed in a somewhat horizontal direction. With a smooth surface, on the underside, of the plastic control plate it was found that there was less control over the tissue projection as was shown with the rough surface of the cardboard control plates. Textured treatments to this underside surface of the plastic and cardboard control plate then resulted in the desired projection of the sheets.

The folded sheets of a folded sheet packet 30 which have reverse folds at opposite sides of the stack of sheets and are described as being C-Folded, as shown in FIGS. 11 and 12, is the standard in the industry, only protrude 31 a set distance through an end opening 6 of the dispenser. This projection is controlled by the weight and the underside texture as well as the floating action of a control plate 20 as it exerts a downward force on the folded sheets and controls the friction between the interplys of the folded sheets in the horizontal lengthwise direction of the folded sheet packet 30.

Figures 18, 19, 20, 21:
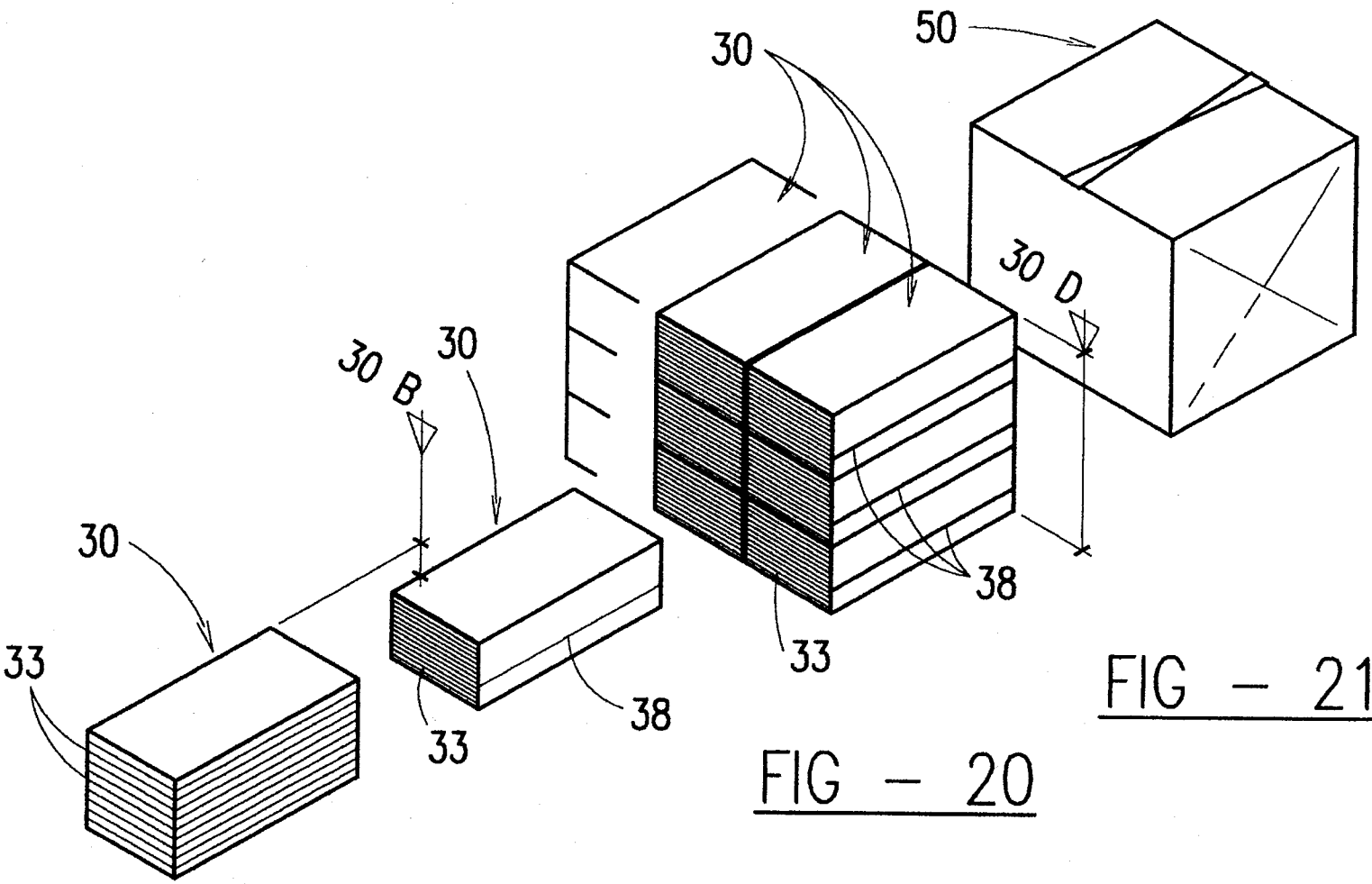
FIGS. 18, 19, 20 and 21 are a series of drawings of the process by which a compressed packet of folded sheet products are accumulated to form a bulk pack.
Figure 25:
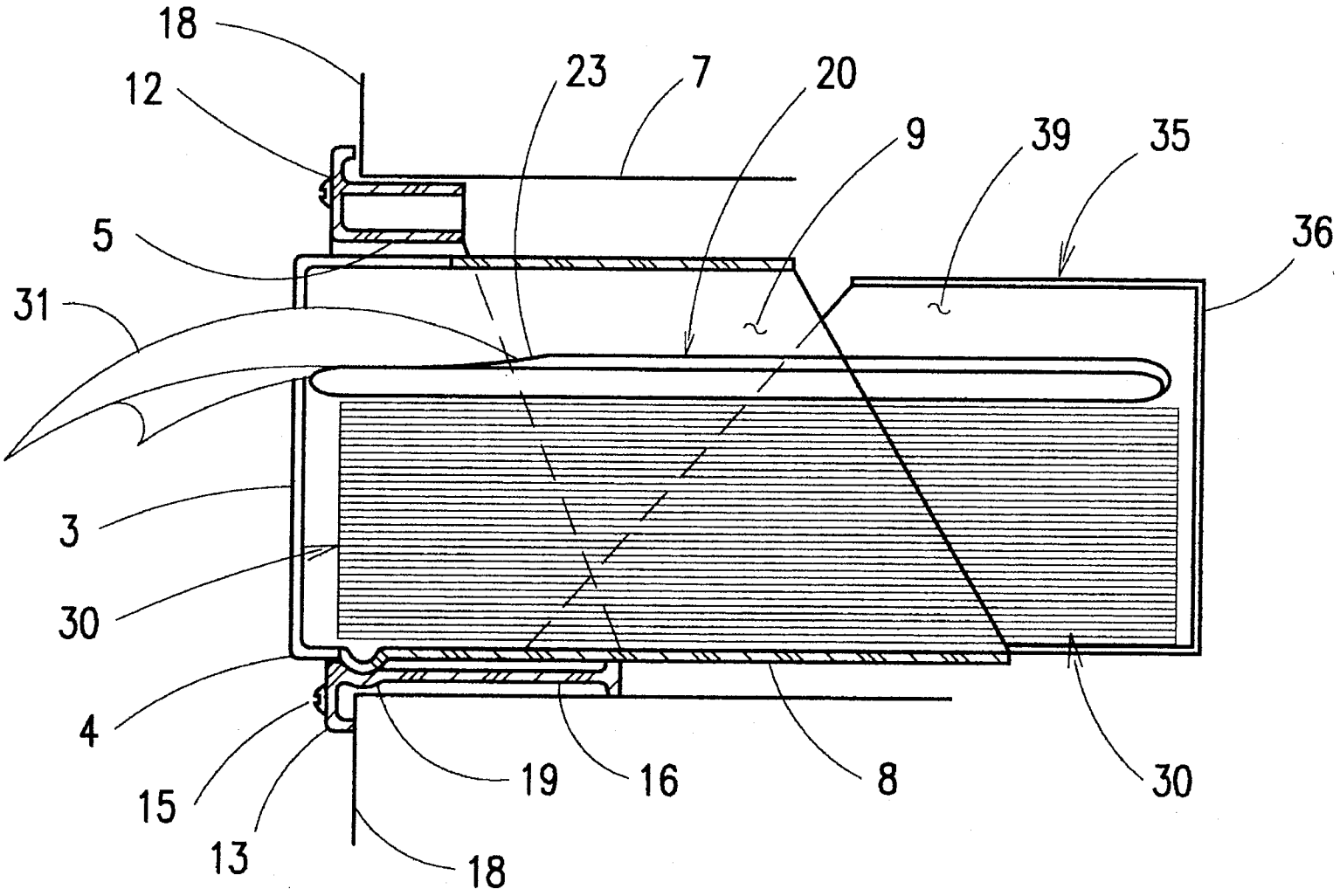
FIG. 25 is a sectional side view of the drawer type, pull out drawer, folded sheet dispenser with the support flange shown attached to a structure.

A fourth embodiment of my invention as shown in FIGS. 18 through 21 is the reduction of volume of a folded sheet pack 30 as produced in the manufacturing of folded sheet products as in FIG. 18 where interlayers 33 of a set width 30W and length 30L are combined in a set count to form a set height 30H which is then compressed vertically 30C by a compressive force 30B by known manufacturing methods (as shown in FIG. 25) which reduces a height 30H to a predetermined height 34. The packet is restrained by a wrapper or sleeve 38 which is removed when the packet is used in the previously mentioned embodiments of my invention. A compressed folded sheet packet 30 is then accumulated as shown in FIG. 20 in multiples of two or three or some other suitable number to form a bulk pack of compressed folded sheet packets of multiple widths and multiple heights and of a preset length. A bulk pack may or may not be further compressed 60 by known means (not shown) and placed in a poly wrapper 61 or enclosed with a poly bag 61 to protectively enclose the bulk pack and which would have a convenient carrying handle or strap 62. A compressed folded sheet packet, as produced and described in this embodiment of my invention, is only now possible to be used with the refillable, molded plastic, dispenser as described in my previous embodiments in that it is released from the restraint wrapper before it is placed inside the molded plastic dispenser which allows the separate layers of folded sheets to expand naturally upwards. The sheets then become loose enough to be removed from the dispenser, one sheet at a time, through the end opening and where they are controlled by the internal control plate.

The folded sheets used in the disposable cardboard dispensers of my invention and as well with the top oval opening dispensers, now common in the industry, cannot be compressed to reduce volume as they are placed within the cardboard dispenser, at the manufacturing plant. The folded sheets must be relatively loose within the dispenser when the end panel is removed and the first sheets are removed by the user. If the folded sheets are packed too tightly within the dispenser they will tear and be pulled apart when they are first removed.

Figure 22:
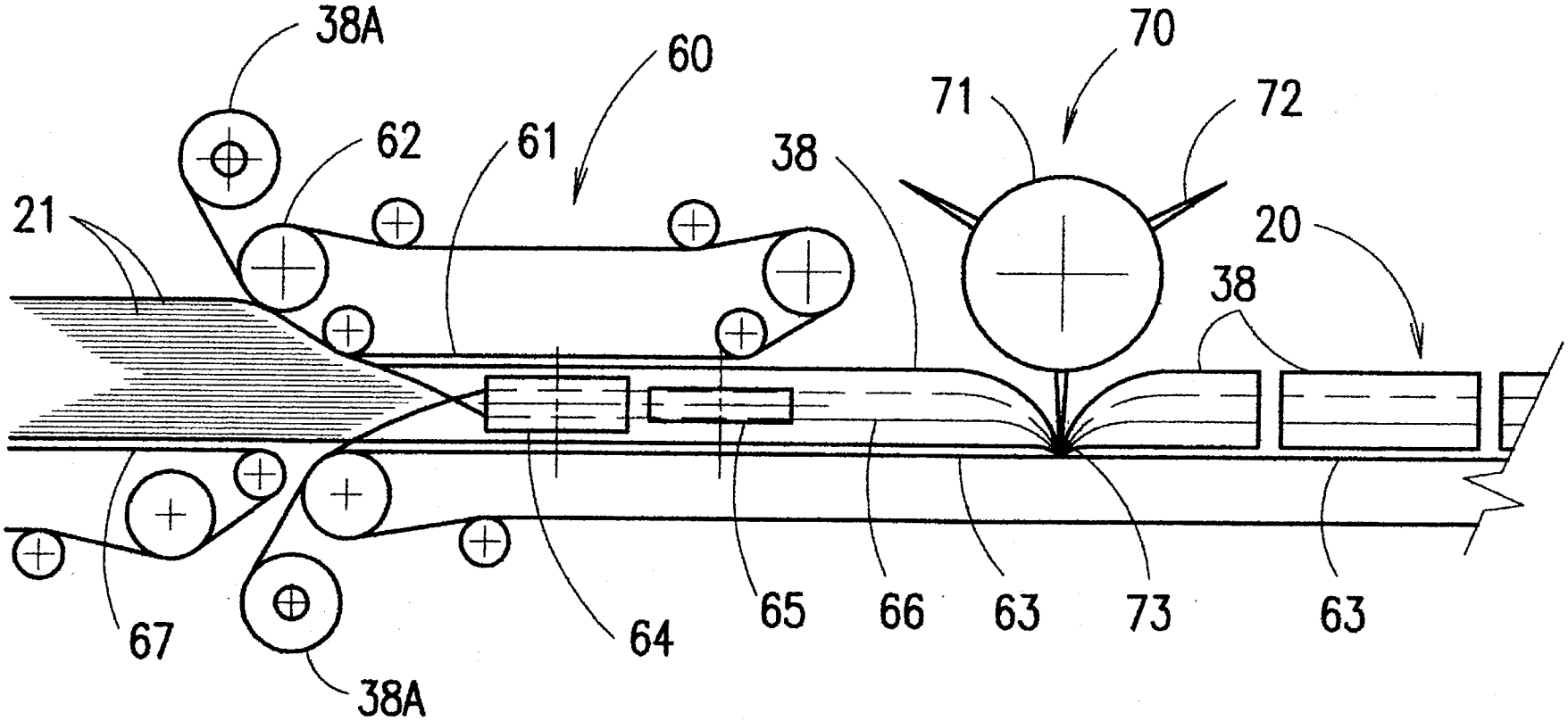
FIG. 22 is a possible mechanical arrangement wherein the compressed folded sheet packet is produced on a conventional manufacturing line.

FIG. 22, shows a possible method of producing a compressed folded sheet packet 20 in a continuous production line from a rope 21 of folded sheets when compressed by a compression belt conveyor 60 on a product line conveyor 63. A top and bottom product roll 38A of recyclable plastic wrap or paper wrap 38 is formed around the rope of folded sheets by a roller 64 and sealed by a method 65 to produce a sealed seam 66 to restrain the compressed rope as it is cut to length by a rotary shear 70 which produces a compressed folded sheet packet 20.

Figure 23:
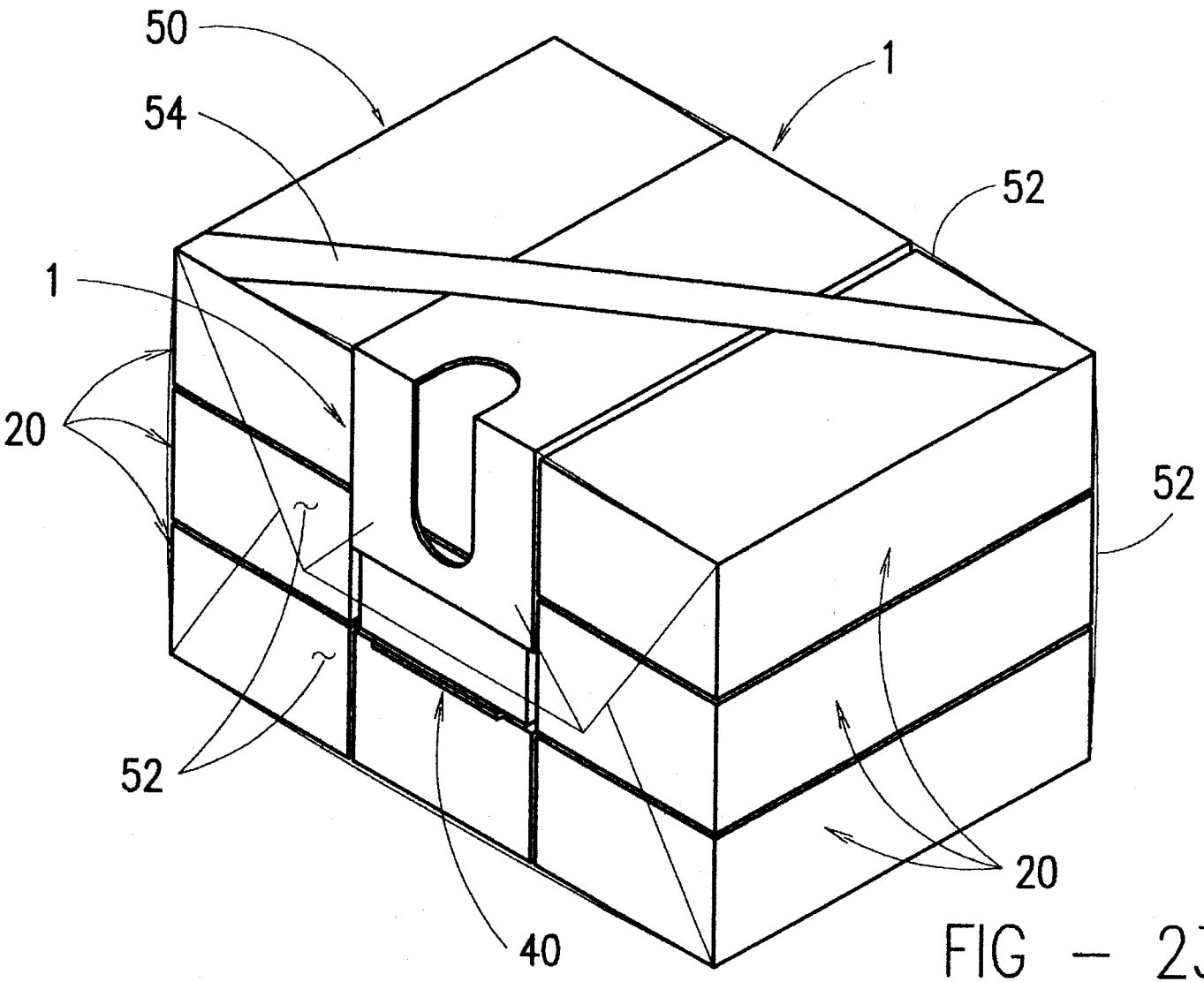
FIG. 23 is an isometric view of a bulk pack of nine folded sheet packets with the refillable, molded plastic, dispenser placed within the package.

Again a further embodiment of my invention is to create as shown in FIG. 23 a bulk pack in which a refillable, molded plastic, dispenser 5 may be placed directly within a poly pack 1 to save boxing and shipping costs in that the dispenser 5 is placed over one and part of another compressed folded sheet packet 20. A control plate (not shown) and a molded plastic bottom 8 are also placed directly inside a poly pack 7 and between the layers of the folded sheet packets 20. By placing the dispenser inside the poly bulk pack you allow the saving in shipping, boxing, and packaging costs for the dispenser as well as the volume reduction costs to defer the higher initial costs for the refillable, molded plastic dispenser. The dispenser will last a number of years and the cardboard containers for these folded sheet products would then not be required. There would be a direct saving to the land fill sites and the energy costs and the trees to produce these cardboard containers would not be required and there would be a direct saving to the consumer and the environment.

Figure 24:
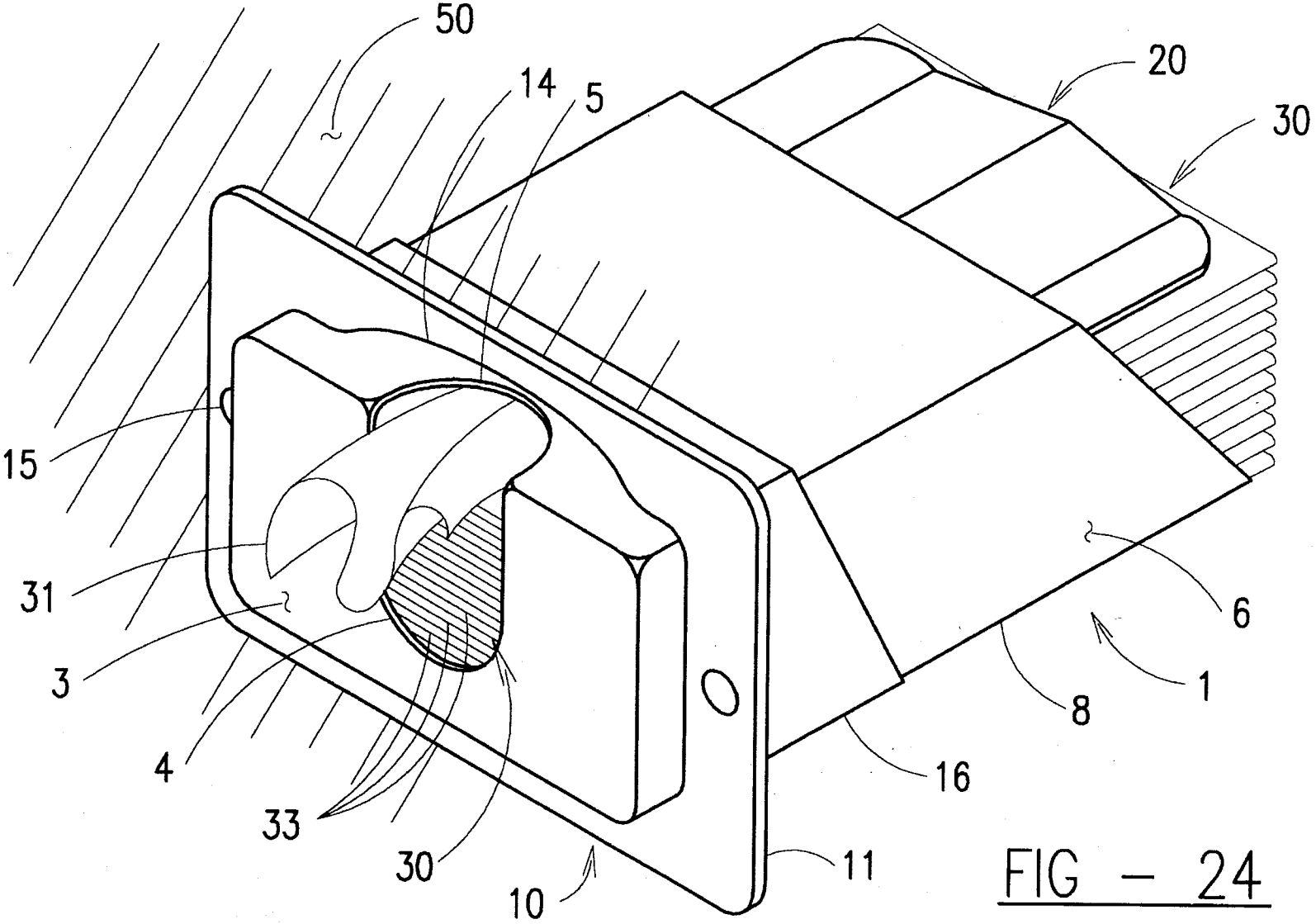
FIG. 24 is an isometric view of the pull-out drawer type dispenser of molded plastic with the vertical front end outlet with a sheet protruding.

Still a further embodiment of my invention is a refillable, molded plastic, folded sheet dispenser as depicted in FIG. 24 where a dispenser is in the mode of a pull out drawer 1 which would have a vertical end opening 3 in a front end wall 2 of the molded plastic drawer type dispenser. A end opening 3 extending up 5 and into a top 7 of the dispenser where a folded sheet protrudes 31 out through the front end opening 3 where it is removed by the user which automatically withdraws the next successive folded sheet as previously described in FIGS. 15, 16 and 17. A folded sheet packet 30 is placed inside the drawer and if a conventional tissue box is used, and cut as shown 37, and then placed inside the pull out drawer 1 through a open end 9 and the control plate 20 is placed on the top most folded sheet within the pull out drawer and the first sheet 31 is started out through the front vertical opening.

The refillable folded sheet dispenser with the folded sheet packet in place is then placed inside a front mounting support flange 12 and inside a support structure 50 which supports a mounting flange 10 where a bottom 8 of the dispenser drawer has a projection 8A which matches a groove 16 in a flange 10 where when a dispenser drawer is inserted all the way as shown in FIG. 25 results in a positive holding position for the dispenser drawer which retains the drawer in place when a folded sheet is removed. When a dispenser is used in an automotive location similar to the dash board or under a seat location the dispenser would be designed for a folded sheet packet of not more than 150 to 200 count sheets in that the space limitations would be directly related to its capacity. The dispenser when used in the face board of a bathroom vanity of a motel or hotel, in the front face of a support structure, where folded sheet products are required, then the dispenser drawer would be of a 150 to 300 folded sheet capacity and the basic design and description as outlined in this embodiment. The dispenser would be based on the two factors which are the heart of my invention, that is, the front vertical opening of the dispenser and the internal control plate.

A dispenser drawer as shown in FIG. 25 must be lifted vertically to allow it to be withdrawn from the support flange 10 to allow it to disengage from a bottom retention ridge 8 when a dispensing drawer is to be removed for filling with folded sheet products. A support flange 10 is attached with fasteners to a support structure through a flange 11 and bottom flange 13 and a top flange 12 has a centrally located "eyebrow" raised portion 14 which allows the folded sheets to be removed more easily from the end openings 3/5 and a support flange 10 extends 16 inside the support structure to support a dispensing drawer 1 when it is closed.

A support flange 10 would be attached to a dash 50 of an automobile or under an automotive seat to a front or rear face of said set 50 where a dispenser would then be removed for filling with a folded sheet product such as facial tissues. A drawer is then placed inside a support flange where the removal of a projecting folded sheet would be controlled by a internal floating control plate 20 which would allow the user to easily remove one tissue 31 at a time from an end opening 3/5 or to also remove a set pack of folded sheets as described in our other embodiments. An internal control plate 20 as described in my previous embodiments is of the same design and purpose as previously described and as depicted in the drawings of FIG. 13.

Figure 26:
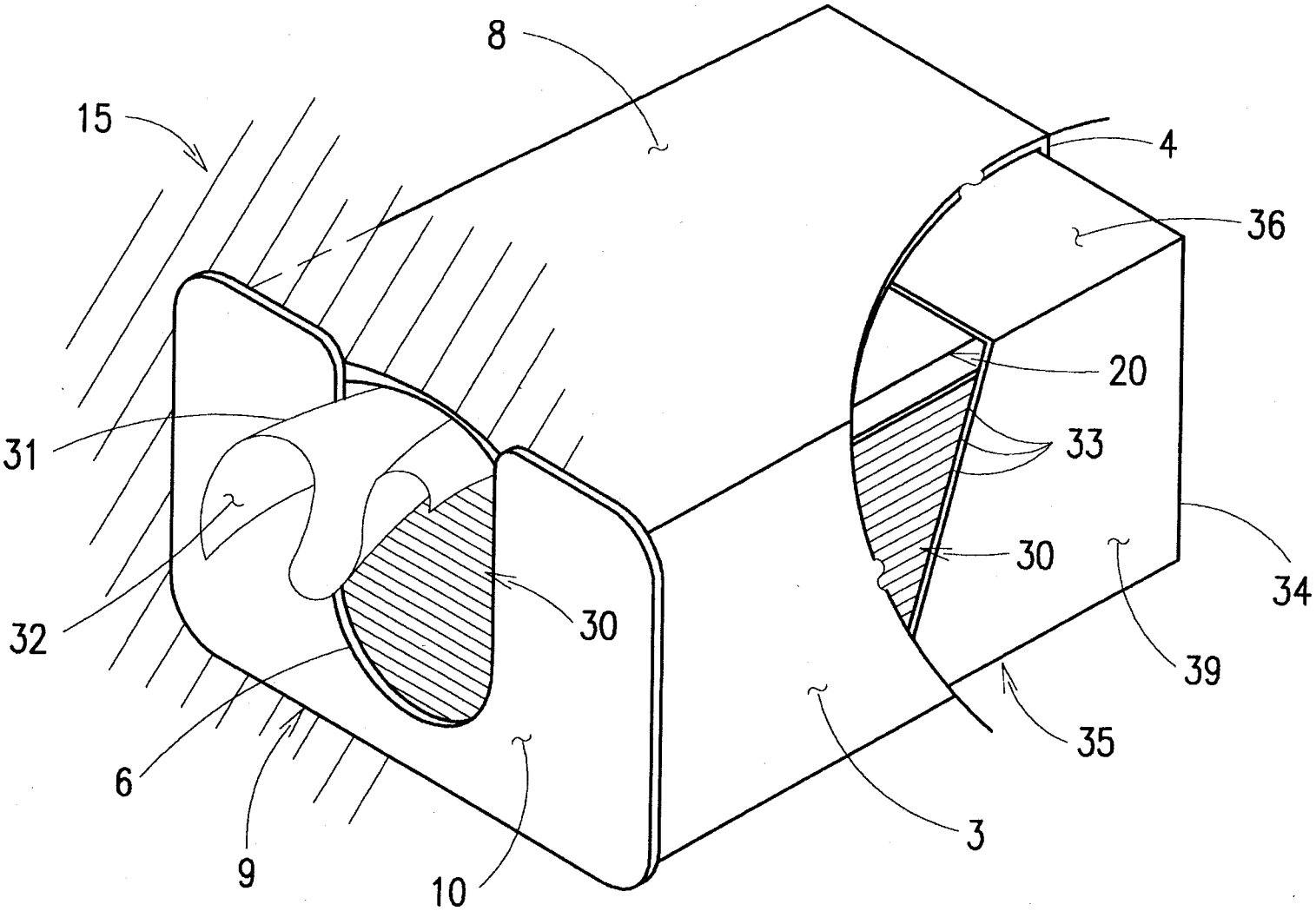
FIG. 26 is an isometric view of a front opening, refillable, molded plastic, dispenser with the vertical slot in the removable front face plate.
Figure 27A:
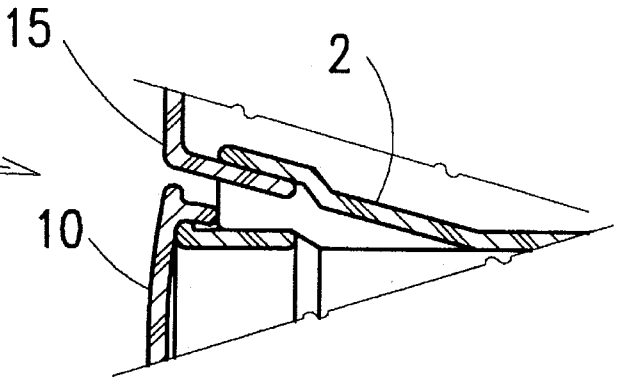
FIGS. 27 & 27A & 27B is a sectional side view of the open front dispenser with alternate details of the removable front plate.
Figure 27B:
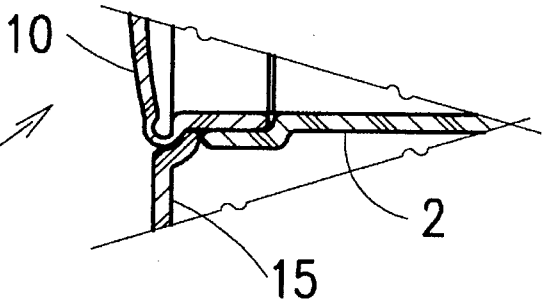
Figure 27:
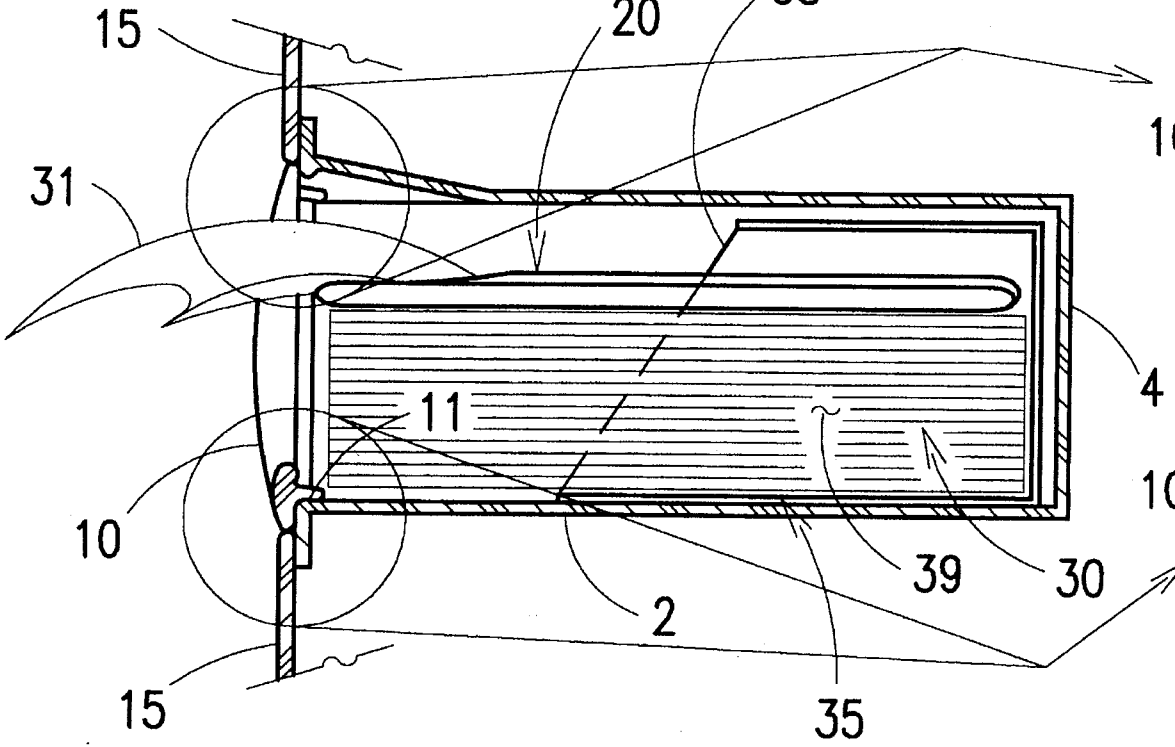

And the final embodiment of my invention as outlined here in FIGS. 26 and 27 would be a refillable, molded plastic, front opening dispenser which would be a closed box with a top 1 opposite sides 3 and bottom 2 with an end 4 and with a front 9 which would be open and would be fitted with a removable or hinged front plate 10 and held in place by projections 11 and 12 with a friction fit as shown in FIG. 27. A dispenser body 1 would be flange attached to a support structure 15 or would be molded into a support structure 15 and made of molded plastic as shown in the enlarged detail FIG. 27A or by some other means made possible with known injection molded plastic technology. A face plate 10 would be snapped out of place or hinged down and out to refill the dispenser with a compressed packet 30 of folded sheets or a cut box 35 of folded sheets 33 would be placed inside a dispenser 1. A control plate 20 is placed on the top most sheet with a cut out 23 facing a vertical opening 6 an front plate 10 where sheet layers 33 would be visible and may be withdrawn as a single sheet 31 or as a set pack of more than one folded sheet.

FIG. 27 is a sectional side view of a open front dispenser as previously described under FIG. 26 and shows a removable or hinged front plate 10 with a protruding folded sheet 31 and folded sheets 33 inside a dispenser. A special cut box 35 of folded sheets with cut edge 38 allowing a control plate 20 to be placed inside a cut box 35. Cut box and control plate are then placed inside the dispenser through a open end 9 and then a front plate 10 would be snapped back in place by a friction catch 12. Or a front face plate with a live plastic hinge could be as shown in FIG. 27B where a front face plate would not be completely detachable but would be live hinged in place and retained by a friction clip.

It will also be understood that other modifications or variations can be made in the structures described herein without departing from the scope of the invention. Other variations and modifications are possible and will be apparent to those conversant in container design with thermo plastic technology and with the technology already at hand by the various folded sheet manufacturers in the production of folded sheet products where convenience to the end user is of a paramount importance and to those skilled in the art all within the intended spirit and scope of my invention.

Although various embodiments of my end opening dispenser with the internal control plate have been shown and described, and as well in the compressed folded sheet packet and the bulk pack system, numerous variations within the spirit of the invention as defined in the appending claims will be obvious to those skilled in the art. Accordingly, the patent is not to be limited to the scope and effect to the specific embodiments here in shown and described nor in any other way that is inconsistent with the extent to which the progress in the art has been advanced by my invention.

What I claim is:

1. A container for dispensing tissues from a stack of folded individual tissues having reverse interleaved folds at opposite sides of said stack, said container including opposite side panels joined at vertical corners to opposite end panels for containing said stack with the opposite sides of said stack disposed adjacent said opposite side panels and ends of said stack disposed adjacent said end panels, and a control plate having bottom tissue engaging surface portions for resting on a top of said stack, one of said end panels having a tissue removal slot disposed between corners at opposite ends of said one end panel and extending downwardly from an upper edge thereof for exposing a portion of one end of said stack, whereby a top tissue of said stack is accessible for removal endwise from beneath said control plate, and due to friction resistance between said top tissue and an immediate subsequent tissue in said stack, said subsequent tissue in said stack, is drawn endwise by the removal of said top tissue to an accessible position projecting endwise partially from beneath said control plate and through said slot in said end panel.

2. A container as defined in claim 1, wherein said slot is centrally disposed between said corners at opposite ends of said one end panel, and wherein said container includes a top panel joined to said end panels along top edges of said end panels said top panel having a centrally disposed opening at one end communicating with the downwardly extending slot of said one end panel.

3. A container as defined in 1 wherein said control plate is a press formed impregnated recyclable material.

4. A container as defined in claim 1, wherein said container is refillable and said control plate is formed of a plastic material.

5. A container as defined in claim 4, wherein the bottom surface of said control plate is convex in cross section thereby providing a clearance between the top tissue of the stack longitudinal of the central portion of the control plate.

6. A container as defined in claim 5, wherein said control plate is substantially the width of said stack, and is provided with a pair of downwardly projecting ridges adjacent longitudinal side edges of said control plate, said ridges being traversely spaced a distance less than the width of said stack, said clearance being positioned between said ridges.

7. A container as defined in claim 1, wherein said container is a refillable container for attachment to an underside of a support structure, said container including a bottom panel integrally connected to said side and end panels and forming a tissue stack containing portion, and a top member having means for permanent attachment to said underside, at least one of said side and end panels included for releasable interlocking said containing portion with said top member and allowing selective removal of said containing portion for filling of said container with a fresh stack of tissues.

8. A container as defined in claim 1, wherein said container is a refillable container for attachment to a substantially vertical support panel defining an opening, said container including a stack supporting bottom panel and attachment means for connecting said container in a supported position at a normally non-accessible side of said support panel, said one end panel of said container being positioned in said opening defined by said supported panel when said container is in said supported position, said one end having selectively releasable locking means associated with at least one of said side panels and bottom panel of container for allowing selective opening of said end panel for filling of said container with a fresh stack of tissue.

9. A container for dispensing tissues from a stack of folded tissues having reverse folds at opposite sides of said stack, said container including opposite side panels and opposite end panels for containing said stack with the opposite sides of said stack disposed adjacent said opposite side panels and ends of said stack disposed adjacent said end panels, one of said end panels having a tissue removal slot extending downwardly from an upper edge thereof for exposing at least a portion of one end of said stack, a top panel joined to said end panels along top edges of said end panels, said top panel having an opening communicating with the downwardly extending slot of said one end panel, and a control plate having bottom tissue engaging surface portions for resting on a top of said stack, an end of said control plate adjacent said slot of said one end panel having a cutaway portion to expose the top tissue of said stack below the opening of said top panel, whereby a top tissue of said stack is accessible for removal endwise from beneath said control plate, and due to friction resistance between said top tissue and an immediate subsequent tissue in said stack, said subsequent tissue is drawn by the removal of said top tissue to an accessible position projecting endwise partially from said slot.

10. A container for dispensing tissues from a stack of folded tissues having reverse folds at opposite sides of said stack, said container including opposite side panels and opposite end panels for containing said stack with the opposite side of said stack disposed adjacent said opposite side panels and end ends of said stack disposed adjacent said end panels, one of said end panels having a tissue removal slot extending downwardly from an upper edge thereof for exposing at least a portion of one end of said stack, a control plate having bottom tissue engaging surface portions for resting on a top of said stack, said bottom surface of said control plate having at least one area defining a roughened surface for increasing frictional resistance to withdrawal of tissue;

whereby a top tissue of said stack is accessible for removal endwise from beneath said control plate, and due to friction resistance between said top tissue and an immediate subsequent tissue in said stack, said subsequent tissue is drawn by the removal of said top tissue to an accessible position projecting endwise partially from said slot.

11. A container for dispensing tissues sequentially from an interleaved stack of tissues, said tissues having reversed folds at opposite sides of the stack, said container including a pair of opposite end walls, a control plate for resting on a top of said stack, one of said end walls having a vertical slot therein for endwise removal of one tissue at a time from beneath said control plate, said control plate having longitudinal side edges spaced apart a distance substantially equal to the width of said stack, and being of crowned configuration whereby a clearance is disposed between said transversely spaced stack engaging surface portions, and a pair of longitudinal extending stack engaging side wall surface portions disposed adjacent said side edges of said control plate and transversely spaced a distance less than the width of said stack.

12. A container as defined in claim 11, wherein at least the end of said control plate adjacent the slot in said end wall is cutaway so as to expose the top tissue of said stack adjacent said slot, and wherein said container includes a top panel formed integrally with said end panels at upper end edges, said top panel having an opening adjacent the upper end edge and in communication with an upper end of said slot, whereby a portion of said top tissue is exposed through said opening of said top panel and the cutaway of said control plate.

13. A container for dispensing tissues sequentially from an interleaved stack of tissues, said tissues having reversed folds at opposite sides of the stack, said container comprising:

a pair of opposite end walls, a control plate for resting on a top of said stack, and a pair of side panels spaced slightly greater than the width of said stack and the width of said control plate, one of said end walls having a vertical slot therein for endwise removal of one tissue at a time from beneath said control plate, said control plate having longitudinal side edges spaced apart a distance substantially equal to the width of said stack, and a pair of longitudinally extending stack engaging surface portions disposed adjacent said side edges of said control plate and transversely spaced a distance less than the width of said stack, said longitudinal edges of said control plate being upwardly turned from said stack engaging surface portions of said control plate.

14. A container as defined in claim 13, wherein said container is a refillable container formed of a plastic material, said container including a removable bottom panel for permitting the insertion of a fresh stack of tissues, and wherein said side panels and said bottom panel include releasable interlocking means for normally holding said bottom panel in a closed position.

15. A container as defined in claim 14, wherein said bottom panel is a relatively rigid member and has longitudinal side edges disposed inside and adjacent said side walls in a closed position, and wherein said interlocking means includes resilient wings projecting from said side edges of said bottom panel, and ribs on inside surfaces of said side panels, said wings latching above said ribs as said bottom panel is pushed upward between side panels for thereby locking said bottom panel from downward removal.

16. A refillable container for dispensing tissues sequentially from an interleaved stack of tissues, said tissues having reversed folds at opposite sides of the stack, said container being in the form of a drawer for longitudinal reception in an opening of a face panel attached to a substantially vertical support panel, said container including a pair of side walls and a stack supporting bottom panel, at least one end wall formed integrally with said side walls and bottom panel, a control plate for resting on a top of said stack, said at least one end wall having a vertical slot therein for endwise removal of one tissue at a time from beneath said control plate, said control plate having longitudinal side edges spaced apart a distance substantially equal to the width of said stack and disposed inwardly of said side walls, and said container having selectively releasable locking means associated with said face panel for locking said container in a concealed position at a normally non-accessible side of said support panel with said one end of said container exposed in said opening of said face panel, said locking means permitting selected removal of said container outwardly through said opening of said face panel for filling of said container with a fresh stack of tissues.

* * * * *